US008943712B2

(12) United States Patent
Buck

(10) Patent No.: US 8,943,712 B2
(45) Date of Patent: Feb. 3, 2015

(54) REMOVABLE ATTACHMENT FOR FOOTWEAR

(76) Inventor: Nancy M. Buck, Cleveland Heights, OH (US)

( * ) Notice: Subject to any disclaimer, the term of this patent is extended or adjusted under 35 U.S.C. 154(b) by 1060 days.

(21) Appl. No.: 12/220,095

(22) Filed: Jul. 22, 2008

(65) Prior Publication Data

US 2010/0018076 A1 Jan. 28, 2010

(51) Int. Cl.

| | |
|---|---|
| ***A43B 23/00*** | (2006.01) |
| ***A43B 3/24*** | (2006.01) |
| ***A43B 3/12*** | (2006.01) |
| ***A43C 7/00*** | (2006.01) |
| ***A43B 23/24*** | (2006.01) |
| ***A43B 3/10*** | (2006.01) |
| ***A43B 1/00*** | (2006.01) |
| ***A43B 3/00*** | (2006.01) |
| ***A43C 11/24*** | (2006.01) |

(52) U.S. Cl.

CPC ..... *A43B 3/105* (2013.01); *A43B 23/24* (2013.01); *A43B 3/126* (2013.01); *A43B 3/24* (2013.01); *A43B 1/0081* (2013.01); *A43B 3/0078* (2013.01); *A43C 11/24* (2013.01)

USPC ..... 36/136; 36/11.5; 36/100; 24/712.3; 2/245

(58) Field of Classification Search

USPC ..... 36/94, 100, 101, 112, 132, 136, 11.5; D2/146, 176, 896–900, 916, 917, 978; 24/306, 442, 712.1, 712.3, 712.6; 2/145, 244–246

See application file for complete search history.

(56) References Cited

U.S. PATENT DOCUMENTS

| | | | | | |
|---|---|---|---|---|---|
| 1,344,998 | A | * | 6/1920 | Fay | 2/245 |
| 3,011,281 | A | | 12/1961 | King | |
| 3,229,340 | A | * | 1/1966 | Herdman | 24/712.3 |
| 3,908,238 | A | * | 9/1975 | Panicci | 24/712.3 |
| 3,999,311 | A | | 12/1976 | Epstein | |
| 4,471,539 | A | | 9/1984 | Mann | |
| 4,553,293 | A | * | 11/1985 | Blum | 24/712.2 |

(Continued)

FOREIGN PATENT DOCUMENTS

| | | |
|---|---|---|
| JP | 2006-130267 | 5/2006 |
| JP | 2006-3123379 U | 7/2006 |

(Continued)

*Primary Examiner* — Clinton T Ostrup
*Assistant Examiner* — Jameson Collier
(74) *Attorney, Agent, or Firm* — D. Peter Hochberg; Sean F. Mellino; Richard A. Wolf

(57) ABSTRACT

A stabilizing device for V-strap sandals wherein the device is engageable with the thong and strap for impeding movement between a wearer's foot and the sandal, and connection means for releasably connecting the stabilizing device to a V-strap sandal. The stabilizing device includes a member having an upper portion and a lower portion which are foldable together, and an opening in a front portion of the lower portion for receiving the thong of a V-strap sandal when the upper and lower portions are moved towards the thong, and connecting structure for connecting the upper portion and the lower portion on each side of the thong to hold the portions together, where the stabilizing device engages the upper part of a wearer's foot to impede movement of the V-strap sandal with respect to the wearer's foot. Also disclosed is a removable accessory for footwear for being folded over and under foot-holding structure on the footwear., and connecting structure for connecting the folded parts of the accessory together when installed on footwear.

3 Claims, 13 Drawing Sheets

(56) References Cited

U.S. PATENT DOCUMENTS

| | | | | |
|---|---|---|---|---|
| D292,441 | S | 10/1987 | Gamm | |
| 4,715,094 | A * | 12/1987 | Herdman | 24/712.3 |
| 4,879,787 | A * | 11/1989 | Walls | 24/712.2 |
| 4,949,437 | A * | 8/1990 | Anderson | 24/712.2 |
| 5,311,679 | A * | 5/1994 | Birch, Sr. | 36/136 |
| 5,857,220 | A | 1/1999 | Erny et al. | |
| 5,913,483 | A | 6/1999 | Polk | |
| 5,918,352 | A * | 7/1999 | Galbreath | 24/712.3 |
| 6,000,111 | A * | 12/1999 | Deskins et al. | 24/712.3 |
| D421,520 | S | 3/2000 | Lawrence et al. | |
| 6,651,359 | B1 | 11/2003 | Bricker | |
| 6,769,204 | B1 | 8/2004 | Phillips | |
| D498,348 | S | 11/2004 | Hunt et al. | |
| 6,904,706 | B2 | 6/2005 | Jones et al. | |
| D512,207 | S | 12/2005 | Choi | |
| 7,044,508 | B2 * | 5/2006 | Burns et al. | 289/1.5 |
| 7,055,265 | B1 | 6/2006 | Bathum et al. | |
| 7,200,959 | B2 | 4/2007 | Spann | |
| D547,532 | S | 7/2007 | White, Sr. et al. | |
| 7,335,178 | B2 | 2/2008 | Berger et al. | |
| 7,404,242 | B1 * | 7/2008 | Perler | 24/712.2 |
| 7,694,436 | B2 * | 4/2010 | Mullen | 36/11.5 |
| 2002/0121030 | A1 * | 9/2002 | Coleman | 36/11.5 |
| 2004/0093765 | A1 | 5/2004 | Baldwin | |
| 2005/0066550 | A1 | 3/2005 | Liu | |
| 2006/0107550 | A1 | 5/2006 | Caminiti | |
| 2006/0210751 | A1 | 9/2006 | Cunningham | |
| 2006/0254085 | A1 | 11/2006 | Mollicone | |
| 2008/0028636 | A1 | 2/2008 | Lusk | |
| 2009/0300948 | A1 * | 12/2009 | Nordstrom-Wehner | 36/136 |

FOREIGN PATENT DOCUMENTS

| | | | |
|---|---|---|---|
| JP | P2006-288907 | A | 10/2006 |
| JP | P2006-130211 | A | 5/2008 |
| JP | P2008-161617 | A | 7/2008 |

* cited by examiner

REMOVABLE ATTACHMENT FOR FOOTWEAR

BACKGROUND OF THE INVENTION

1. Field of the Invention

This invention relates to footwear, and particular to devices for improving the fit and appearance of footwear such as sandals and other footwear having a portion extending over the top of a wearer's foot.

2. Description of the Prior Art

Sandals have been very popular for many years, and are widely used indoors and outdoors except in very cold weather. One of the most common types of sandals are V-strap sandals, where two ends of a V-shaped strap are attached to the sole of the sandal on the opposite sides of the sole where a wearer's foot would rest, and the connection of the intersection of the straps of the V-shaped strap with a thong or toe piece extending from the sole for placement between the big or first toe and the second toe of the wearer's feet. In general, more expensive V-strap sandals are made from leather, suede, patent leather, metallic finished material, fabric and other textiles. Less expensive V-strap sandals are called "flip-flops," and are generally made from a rubber-like material or from vinyl or other artificial leather material. V-strap sandals in general, and flip-flops in particular, do not usually fit well, and are often quite loose. It is very common for persons wearing V-strap sandals, and especially flip-flops, to accidentally have one of their feet slip to the side and/or go over the edge of the sole, actually have the V-strap sandal slip off the foot while walking, fly off in the event the wearer goes through a kicking motion, have the end of the sole slip slightly off the front of the toes while walking and get struck in the ground to cause tripping or falling, and slip sideways off the V-strap sandal to result in a sprained ankle or the like.

In addition to these safety issues relating to V-strap sandals, and especially flip-flops, these types of footwear is often unattractive or at least look inappropriate when worn in various situations. People are often embarrassed by simply going shopping wearing flip-flops or many other types of V-strap sandals because not only are they loose fitting, but they appear extremely informal, i.e. sloppy. Flip flops and other V-strap sandals have numerous varieties on the market. The soles can be one layer or multilayer. The V-shaped straps can be attached on the side edges of the sole or on top of the sole, and forward or rearward along the side of the sole. The part of the heel portion of the V-shaped strap could be a continuous piece and embedded in the heel part of the sole, or have the ends attached in any number of ways to the rear part of the sole or be raised up to engage the back of the wearer's heel. The thong could be fixed at on end to the forward part of the sole, or fixed to a post extending upwardly from the sole. The thong could be integral with the V-shaped strap or attached thereto by sewing, adhesives, molding, and the like. The V-strap also could be attached to the sole by being placed between layers of the sole, riveted, sewn, molded or fixed by adhesives to or within the sole. The forward portions of the V-strap could incorporate part of the thong. The invention described below can work with virtually every kind of flip-flop and other V-strap sandals. In some situations, people would want to change the appearance of the flip-flops or other V-strap sandals, such as to fit some type of theme or environment, such as athletic, formal, Latin American, outdoors, an amusement theme for children or adults, school, employment or fraternal organizations and numerous other themes. There is thus a need for converting flip-flops and other V-strap sandals from an initial appearance to any desired theme, and it would be particularly advantageous to make conversions from one theme to another in a fast and inexpensive manner.

Flip-flops and other V-strap sandals are often used simply to protect the feet, and are frequently worn in very informal situations where the wearer has few if any places to store important items such as pharmaceuticals, keys, watches, a GPS system, miniature telecommunication devices and the like. Flip-flops and V-strap sandals have previously not been able to store such items by means of removable accessories. Although utilizing this type of footwear for storage purposes may have occurred to others in the past, it would be uneconomical for manufacture of such footwear and add the expensive storage compartments on large quantities of footwear when many possible buyers of footwear would not want such storage compartments. In addition to the convenience that some people may want for having a storage area associated with flip-flops and other V-strap sandals, such storage areas are particularly important in some situations such as for children separated from parents or other guardians who have intercommunication or location identification devices, identification devices and small cell phones; people under the care in sanatoriums and the like who need electronic locating systems, drug supplies. People in remote areas or on beaches, who are wearing flip flops and other V-strap sandals and may want to carry keys, timepieces, drugs, locating systems, telecommunication devices such as cell phones, and the like. Such people would find it very helpful to have a carrying device other than a handbag as a storage facility which would not impair movement of their arms, legs or shoulders and not require pockets or enlarged pockets as might otherwise be necessary for bathing suits, recreational clothing, etc.

Another type of footwear suffering some of the same shortcomings of V-strap sandals, are footwear where a portion of the footwear goes over the foot of the wearer and does not have a thong. One type is disclosed in U.S. Pat. No. 6,993,858 (Seamans, 2006) describing footwear which is known by the name of assignee, Crocs.

Accessories for footwear are well known for a variety of purposes. Accessories for flip-flops and other sandals are known, particularly for decorative purposes. Prior art disclosing such decorative accessories include U.S. Pat. No. 3,748,757 (an enlarged decorative top portion carried on the top of a thong), U.S. Pat. No. 6,769,204 (a foot retaining strap and a ribbon having a visible decorative portion and a lower portion for attachment to the strap by hook and loop fastener structure), U.S. Pat. No. 7,200,959 (a flip-flop having a strap with receiving members for receiving interchangeable connecting pieces), Pub. No.: US2004/0093765 (Published May 20, 2007; a flip-flop having V-shaped straps having a releasable cover with ornamental beads thereon) and Pub. No.: US2006/0254085 (Published Nov. 16, 2006; a flip-flop having a fabric cover wrapped around the V-shaped strap of the flip-flop). There are also a number of design patents disclosing decorative accessories for flip-flops, namely, U.S. D535,186 (Boschok 2006; an artificial flower at the intersection of the two parts of a V-shaped strap), D498,348 (Hunt et al. 2004; a series of ribbons wrapped around V-shaped strap of a flip-flop) and D421,520 (Bonny et al. 2000; a floral T-bar on the V-shaped strap of a flip-flop). Japanese Publications 2006-130267, 2006-130268 and 2006-130269 disclose thong ornaments for flip-flops.

There are also known numerous patents disclosing various decorating accessories for sandals and open women's shoes, including the following: U.S. Pat. No. 2,344,620 (Langley 1944), U.S. Pat. No. 4,450,633 (Connelly 1984), U.S. Pat. No. 4,461,102 (DeVincentis 1984), U.S. Pat. No. 2,971,278 (Scholl 1961), U.S. Pat. No. 5,992,058 (Jneid 1999), Pub.

No.: US2005/0011087 (Stevens, Published Jan. 20, 2005), Pub. No.: US2005/0066550 (Liu, Published Mar. 31, 2005), Pub. No.: US2006/0107550 (Caminiti, Published May 25, 2006), and design patent numbers D346,686 (Hatfield 1994), D512,207 (Choi 2005) and D530,240 (Kelsey 2006).

Pocket, pouches and other containers are also known for footwear. In U.S. Pat. No. 4,471,539 (Mann 1984) a pocket is positioned on a side strap extending from the sole to the thong of the sandal. In D292,441 (Gamm 1987), a sandal with a wrap over strap has a pocket on the strap. Numerous pockets are known for use with shoes with laces, where the pocket is attached to the shoe by the laces, including U.S. Pat. No. 2,662,677 (Perry 1953), U.S. Pat. No. 4,254,566 (Haskell 1981), U.S. Pat. No. 4,327,512 (Oliver 1982), U.S. Pat. No. 4,507,882 (Harrell 1985), U.S. Pat. No. 4,536,975 (Harrell 1985), U.S. Pat. No. 4,630,383 (Gamm 1985), U.S. Pat. No. 5,094,016 (DiVito 1992), U.S. Pat. No. 5,311,679 (Birch 1994), U.S. Pat. No. 5,596,821 (Solo 1997), U.S. Pat. No. 5,775,011 (Britano 1998), U.S. Pat. No. 6,397,497 (McAtee 2002), U.S. Pat. No. 6,449,881 (Assaf et al. 2002), Pub. No.: US2004/0163285 (Johnson; Published Aug. 26, 2004) and Design Pat. Nos. D369,458 (Adams 1996) and D382,691 (Fuller et al. 1997).

Various accessories for decorating lace-up shoes are also known in the art, as evidenced by U.S. Pat. No. 5,845,422 (Valteau, III 1998), U.S. Pat. No. 5,979,085 (Ross et al. 1999), U.S. Pat. No. 6,412,197 (Krull 2002), U.S. Pat. No. 6,640,467 (Krull 2003), U.S. Pat. No. 7,000,337 (Harrington 2006), Pub. No.: US2006/0010721 (Valko; Published Jan. 16, 2006) and D404,770 (Meade et al. 1999). A decorative strap for attachment to a slip-on moccasin is disclosed in U.S. Pat. No. 3,999,311 (Epstein et al. 1976).

There are also a large of number of patents disclosing accessories for use with lace-up shoes for protecting the laces, including U.S. Pat. No. 910,308 (Peters 1909), U.S. Pat. No. 2,650,399 (Torelli 1953), U.S. Pat. No. 2,871,537 (Hickerson 1959), U.S. Pat. No. 3,473,198 (Meier 1969), U.S. Pat. No. 3,822,489 (Johnson 1974), U.S. Pat. No. 4,428,101 (Harkavy 1984), U.S. Pat. No. 4,553,293 (Blum 1985), U.S. Pat. No. 4,597,198 (Schweitzer 1986), U.S. Pat. No. 4,879,787 (Walls 1989), U.S. Pat. No. 5,209,000 (Rowland et al. 1993), U.S. Pat. No. 5,313,719 (Koethe 1994), U.S. Pat. No. 5,402,589 (Lubrani et al. 1995), U.S. Pat. No. 5,459,947 (Lascher 1995), U.S. Pat. No. 5,566,477 (Mathis et al. 1996), U.S. Pat. No. 5,671,517 (Gourley 1997), U.S. Pat. No. 5,913,483 (Polk 1999), U.S. Pat. No. 6,952,864 (Moreno 2005), U.S. Pat. No. 6,988,298 (Temasky et al. 2006), U.S. Pat. No. 7,003,903 (Johnson 2006) and U.S. Pat. No. 7,117,616 (Hull 2006). Other decorative accessories are disclosed in U.S. Pat. No. 4,733,439 (Gentry 1988), U.S. Pat. No. 5,165,190 (Smyth 1992) and U.S. Pat. No. 5,857,220 (Emy 1999). Design patents disclosing devices to be attached to shoelaces are shown in Design Pat. Nos. D210,649 (Getgey 1968), D406,177 (Milroy 1999) and D481,864 (Landry 2003). Other attachments for shoes having sole wiping pads are disclosed in U.S. Pat. No. 4,823,426 (Braggs 1989), U.S. Pat. No. 5,421,106 (Emerick 1995), U.S. Pat. No. 6,128,801 (Adzick et al. 2000). Other lace-on attachments for shoes are shown in U.S. Pat. No. 6,278,378 (athletic performance and entertainment products Feiner et al. 2001), U.S. Pat. No. 6,729,088 (mounted picture; Ferguson 2004), U.S. Pat. No. 6,684,543 (identification tag; Fernan 2004) and D401,934 (pager module, Wicks 1998). There are also devices known for changing replaceable straps for open face women's shoes for decorative reasons, as disclosed in U.S. Pat. No. 4,439,935 (Kelly 1984) and U.S. Pat. No. 6,651,359 (Bricker 2003). Design straps for sandals are known from various design patents including the following U.S. design patents: D468,523 (Steger 2003), D514,285 (Mouchi et al. 2006), D519,723 (Mouchi et al; 2006), D521,213 (Mouchi et al. 2006) and D523,214 (Mouchi et al. 2006)

BRIEF SUMMARY OF THE INVENTION

An object of the present device is to provide a removable stabilizing accessory for a flip-flop and other V-strap sandals for stabilizing the latter footwear on a wearer's foot to prevent it from inadvertently being removed or loosened on the wearer's foot.

Another object of the present invention is to provide a removable accessory for a flip-flop or other V-strap sandal to change the appearance of the latter footwear.

It is also an object of the invention to provide a stabilizing accessory for a flip-flop or other V-shaped sandal which can easily be attached to the latter footwear and be firmly held thereon, but which can also be manually removed therefrom.

An additional object is to provide an attractive accessory which can be firmly attached to a flip-flop or other V-strap sandal for changing the design of the latter footwear.

It is yet still another object of the present invention to provide an attachment accessory having a storage container holding keys, a timepiece, identification devices, pills and the like, which can be worn on a flip-flop or other V-strap sandals for providing safe storage without necessitating the use of one's hands or a purse or other shoulder or hand held storage device.

Another object of the invention is the provision of a small storage accessory to be carried by a flip-flop or other V-strap sandal which is smaller than a typical clothing pocket, easily transportable and unnoticeable.

A yet further object of the present invention is to provide a variety of removable accessories which covers all or part of the V-shaped strap and thong of a flip-flop or other V-shaped sandals employing hook and loop type fasteners.

It is also an object to provide easily replaceable accessories for flip-flops and other V-strap sandals having a slit or other opening for allowing the accessory to be slid forwardly with the thong entering the slit or other opening and being releasably retained therein.

It is still an additional object of the invention to provide a stabilizing device for footwear which does not have a thong but rather a portion such as an upper that goes over the top of a wearer's foot.

An additional object is to provide a removable accessory for the upper of footwear having an upper and apertures extending through the upper.

A further object is to provide a device for a removable accessory for footwear which is held on a wearer's foot by traversing the top of the wearer's foot.

These and other objects should be apparent from the description to follow and from the appended claims.

The foregoing objects are achieved with a removable accessory for footwear The footwear preferably includes a sole, foot-holding structure such as V-straps connected to the sole and to a thong for placement between toes of a wearer or an upper attached to the sole, the foot-holding structure having accessible openings such as the openings forward and rearward of the thong and the straps or through the upper, a member having a first portion disposable on the inside of the foot-holding structure for decreasing the space between the foot-holding structure and a wearer's foot to stabilize the footwear on the wearer's foot and/or add decoration to the footwear and a second portion disposable on the outside of the foot-holding member, and connecting structure on the first and second portions for releasably locking the first and second portions together at the accessible openings. The member is manipulatable to engage the foot-holding structure with the connecting structure on the first and second portions of the member and with the connecting structure on the first and second portions in alignment for being urgeable together to releasably lock the first and second portions to the foot-holding member.

DETAILED DESCRIPTION OF THE INVENTION

Figure 1:
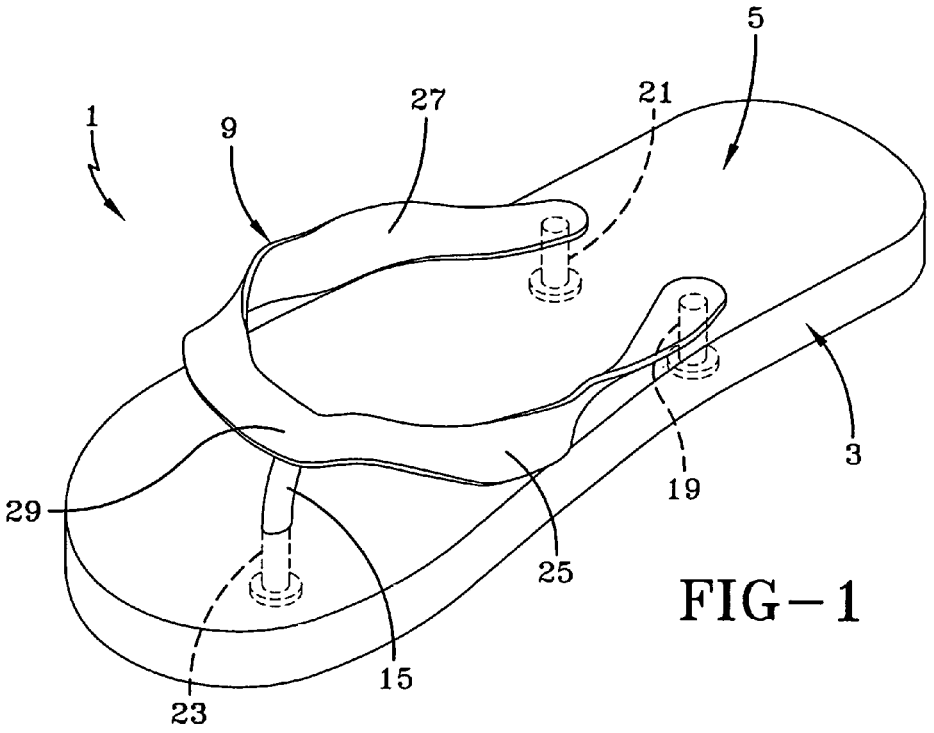
FIG. 1 is a perspective view of a flip-flop.
Figure 5:
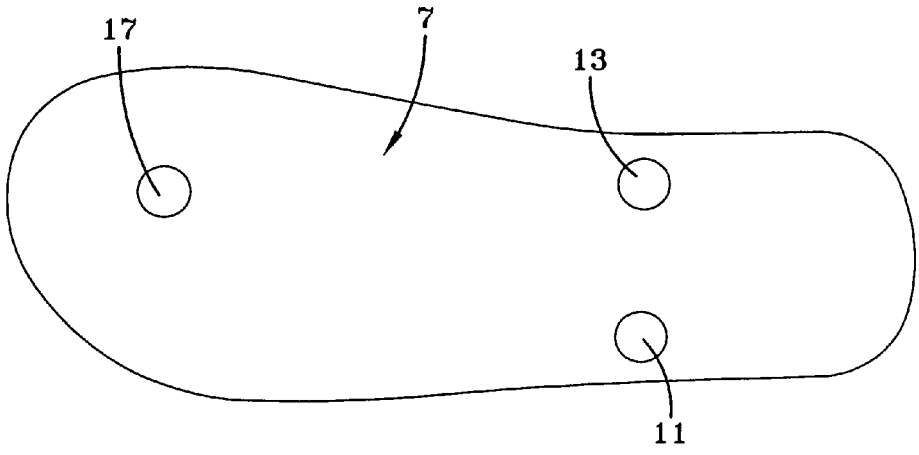
FIG. 5 is a bottom view of the flip-flop shown in FIG. 1.
Figure 2:
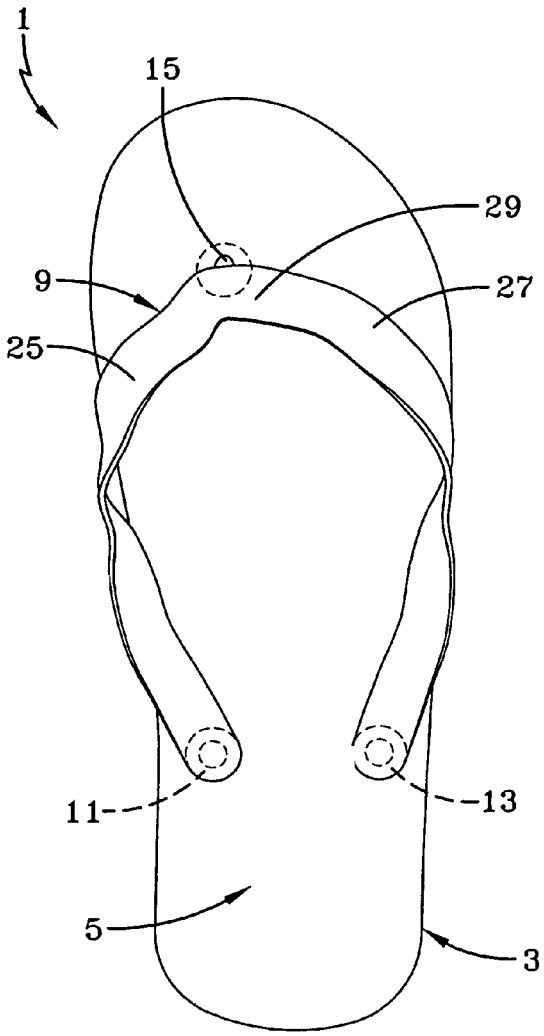
FIG. 2 is a top view of the flip-flop shown in FIG. 1.
Figure 3:
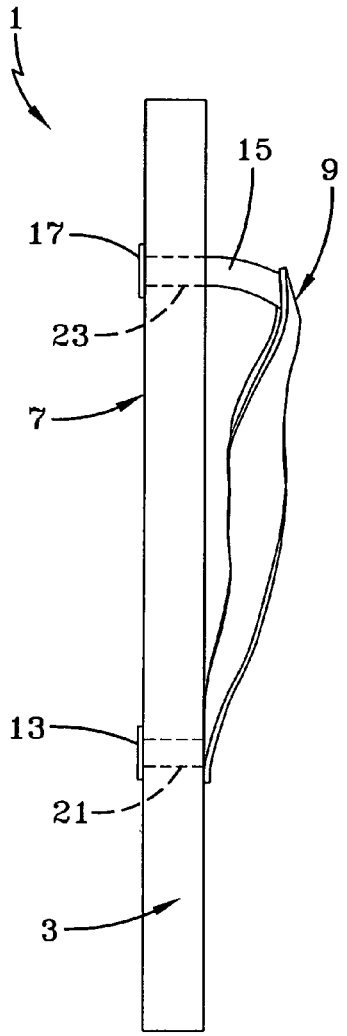
FIG. 3 is a side view of the flip-flop shown in FIG. 1.
Figure 4:
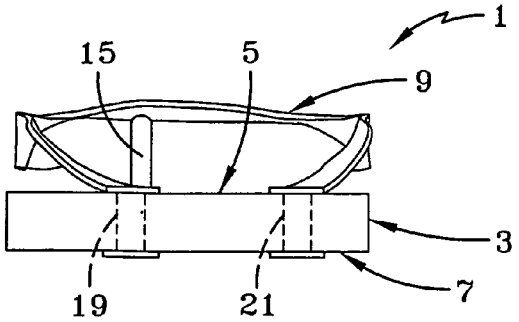
FIG. 4 is an end view of the flip-flop shown in FIG. 1.

A typical V-strap sandal 1 is shown in FIGS. 1-5, which is shown as a flip-flop, and referred to herein as a V-strap sandal or flip-flop. V-strap sandal 1 is one type of footwear with which the present invention can be used. Flip-flops are also known as thong sandals, and the terms V-strap sandals and flip-flops include thong sandals. Sandal 1 comprises a flat sole 3 having a foot receiving surface 5 and ground bearing surface 7 on the opposite of sole 3 from foot receiving surface 5. Although sandals 1 are described having a flat sole, the invention and the embodiments described herein can be used with non-flat soles, such as those with raised heels, slides, wedges, high heels, heels lower than the front of the sole and undulating soles. Sandal 1 has a V-shaped or U-shaped strap 9 (V-shaped straps and U-shaped straps will be referred to herein as V-shaped straps) connected at opposite ends 11 and 13 to sole 3, and a thong 15 extending from sole 3 having an end 17 for attachment to sole 3, and an opposite end connected to V-shaped strap 9. V-shaped strap 9 and thong 15 are foot-supporting structures. Thong 15 is positioned between the big toe and the first toe of a wearer's foot. Flip-flops often have holes extending through them where the V-shaped straps are connected to sole 3. With respect to flip-flop 1, ends 11 and 13 of strap 9 extend through a pair of holes 19 and 21 on opposite sides of sole 3, ends 11 and 13 being enlarged so they cannot pass through holes 19 and 21 once strap 9 has been assembled with sole 3. Likewise, thong 15 has its end 17 extending through a hole 23 in the forward part of flat sole 3 between the place where the first or big toe and the second toe would normally be, and end 17 is enlarged as were ends 11 and 13 to prevent thong 15 from being pulled through hole 23 and release thong 15 from hole 23. V-shaped strap 9 has a first strap portion 25 extending from end 11 along the resting place of the big toe to thong 15 and a second strap portion 27 partly crossing the remainder of the foot from end 13 to thong 15. First strap portion 25 and second strap portion 27 meet at a throat 29. Strap 9 need not be directly attached to thong 15, and there could be intermediary members between strap 9, or parts of strap 9 and thong 15.

Oftentimes the V-shaped strap and the thong can be a one piece article, and can be molded as an integral unit when made from real or artificial rubber. Although the ends of the V-strap can extend through holes in the flat sole, they can be stitched, held by adhesives or held in place by other layers of material extending across the flat sole and over the end portion of the V-shaped strap and the like. As explained earlier, the V-shaped band can be stitched, held by adhesives, riveted, molding material and the like to the sides of the sole or to upper rear portions of sole 3. The V-shaped strap could be continuous across the heel portion of the flip-flop, and either extend under the upper layer(s) of the rear portion of sole 3 or act as a heel piece to retain the flip-flop on the wearer. One or more parts could extend from the sole to be engaged by the thong and/or V-shaped strap. Sole 3 could be flexible and made from rubber, artificial rubber, selected ones of many plastics, leather or artificial leather, vinyl and the like, or could be inflexible and made from wood, an appropriate hard plastic or the like. The V-shaped strap is usually flexible, and could be made from rubber or artificial rubber, leather or artificial rubber, vinyl or other plastic, metal such as chains or coated chains, fabric and the like. Thong 15 could be flexible or inflexible and made from the same type of material as the sole or strap, and could be made as one piece or as multiple pieces.

V-strap sandals are typically loose when worn on a person's foot, and there is usually a gap between the underside of the V-shaped strap and the sole so that the sandal will fit on feet of various thicknesses. The result is that most V-strap sandals have play on the wearer's foot due to the gaps, which renders V-shaped sandals loose fitting and unsafe.

Figure 6:
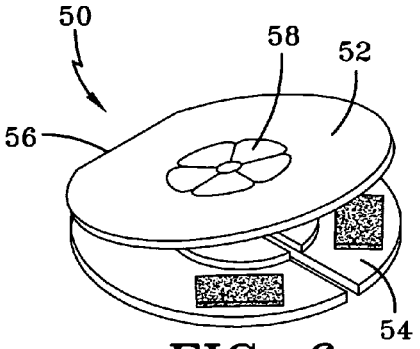
FIG. 6 is a perspective view of a first embodiment of the invention.
Figure 7:
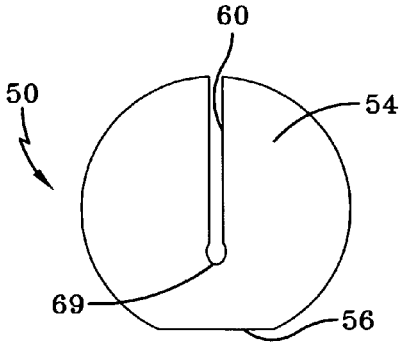
FIG. 7 is a bottom view of the embodiment shown in FIG. 6
Figure 8:
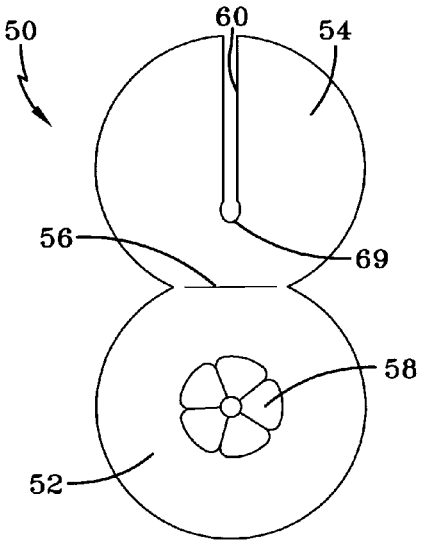
FIG. 8 is a top view of the exterior of the embodiment of the invention shown in FIG. 6, with the stabilizing device shown in an unfolded condition.
Figure 9:
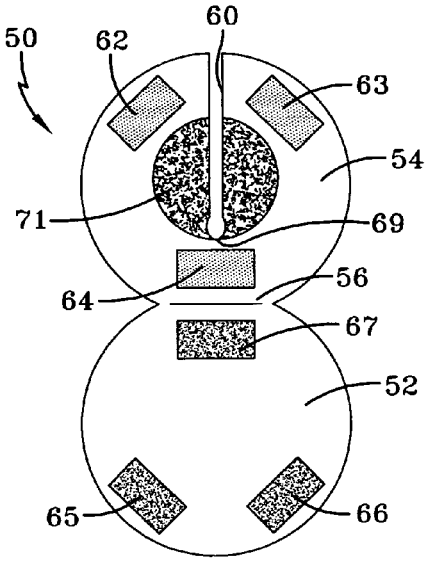
FIG. 9 is a top view of the interior of the embodiment of the invention shown in FIG. 6, with the stabilizing device shown in an unfolded condition.

A removable accessory or stabilizing device 50 according to one of the embodiments of the invention is shown in perspective form in FIG. 6, a bottom view in folded form in FIG. 7, an exterior view in FIG. 8 and an interior view in FIG. 9, the latter two figures showing the inventive device according to this embodiment in the unfolded or open condition. Stabilizing device 50 has a first or upper portion 52, a second or lower portion 54 and a folding portion 56. Upper portion 52 is the portion which will be seen by others when stabilizing device 50 is installed on a sandal, and it appropriately has a design, identified generally by numeral 58. Lower portion 54 has a slit or other front-rear opening 60 for receiving thong 15 when stabilizing device 50 is installed on a V-strap sandal. In order to keep upper portion 52 and lower portion 54 releasably locked in place, some connecting structure is needed. Referring to FIG. 9, a series of loop devices 62, 63 and 64 are attached to the interior of lower portion 54, and a series of hook devices 65, 66, and 67 are attached to the interior of upper portions 52. The hook and loop devices are sold commercially under the name Velcro. Loop devices 62, 63 and 64 are in alignment with hook devices 65, 66 and 67 when upper portion 52 and lower portion 54 are folded together, so that the respective loop and hook devices are releasably coupled, connected or locked together. The loop and hook devices can be interchanged, and can be placed anywhere on the interiors of upper portion 52 and lower portion 54, so long as they interact when upper portion 52 and lower portion 54 are folded together. Loop devices 62, 63 and 64 and hook devices 65, 66 and 67 are just one of the numerous types of connecting structure which could be used to releasably connect upper portion 52 and lower portion 54 together. The connecting structure could be mechanical snaps, an appropriate adhesive, an appropriate adhesive tape, button holes and buttons, magnets, a cord, twine or a shoelace, which could be releasably knotted together, buttons, zipper structure and the like.

Figure 10:
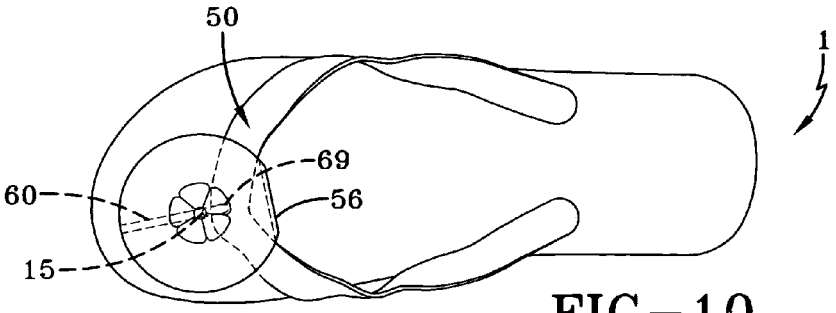
FIG. 10 is a perspective view of the embodiment of the invention shown in FIGS. 6-9, installed on a V-strap sandal.

In order to install stabilizing device 50 on a V-strap sandal 1 or any other type of V-strap sandal, a person merely manipulates stabilizing device 50 by opening it so that the connecting structure are in an open position. Slit 60 is slid on thong 15 so that thong 15 is preferably located at or near an end 69 (depending on the construction of stabilizing device 50) of opening 60 with upper portion 52 being above lower portion 54 and distal from sandal 1. Upper portion 52 and lower portion 54 are then rotated together about folding portion 56 which acts as a living hinge, until the cooperating connecting structure are releasably locked together. Stabilizing device 50 is then in place, as shown in FIG. 10.

One of the advantages of the stabilizing device according to the invention is that it makes the engagement of sandal 1 with a foot inserted in the sandal firmer because stabilizing device 50 in effect presses the foot against sandal 1. In order to enhance this effect, a thickening device 71 could be employed. Thickening device 71 could be a wool product or artificial wool product which is held fast to a backing material which is in turn attached by an adhesive means or the like to lower portion 54 according to the embodiment of the invention being described. The thickening device could be additional layers of the material that make lower portion 54 or constitute some material attached to lower portion 54. If thickening device 71 is attached to lower portion 54 across slit or opening 60, it too would need a slit for receiving thong 15 from V-strap sandal 1. Thickening devices could be inserted on the inside of upper portion 52 around the edges of upper portion 52 and/or lower portion 54 as well. Thickening device 71 is preferably made of a resilient material so that it would press against a wearer's foot in a gentle manner so as not to injure the foot or make stabilizing device 50 uncomfortable to the wearer.

Figure 11:
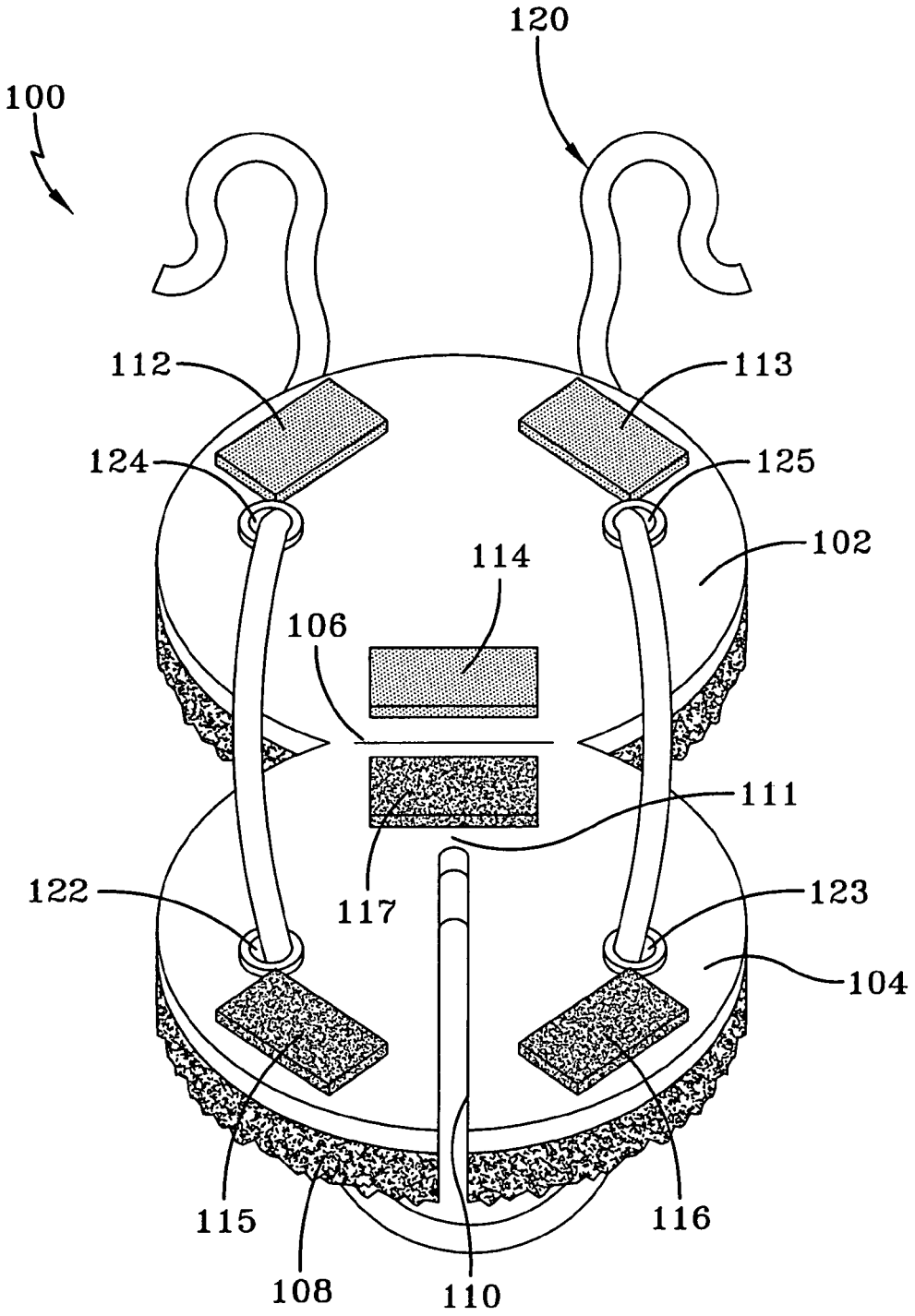
FIG. 11 is a top view of the interior of a variation of the first embodiment of the invention shown in FIGS. 6-10, in an unfolded condition.

FIG. 11 shows a similar removable accessory or stabilizing device where the upper and lower portions are releasably connected together in a closed fashion by means of a leather shoelace. Thus, FIG. 11 shows a stabilizing device 100 having a first or upper portion 102 and a second lower portion 104, which are connected together by a folding portion 106. Stabilizing device 100 is shown as being formed of sheep skin with an outer layer 108 being sheared wool. Besides being attractive, wool 108 is thick and resilient, and thus assists in forcing a foot closer to a sandal on which device 100 has been installed. A set of looped devices 112, 113 and 114 are attached to upper portion 102, and hook portions 115, 116 and 117 are attached to lower portion 104 so that the respective pairs of connecting structure will contact and releasably hold each other when upper portion 102 and lower portion 104 are moved to the closed position.

A leather shoelace 120 also releasably locks upper portion 102 and lower portion 104 in a releasably locked position, as well as adding an attractive device to stabilizing device 100. A set of lace holes 122, 123, 124 and 125 are provided so that leather shoelace 120 can be threaded into lower portion 104 and upper portion 102.

In order to install stabilizing device 100 on a V-strap sandal, one merely manipulates device 100 by moving lower portion 104 towards thong 15 until thong 15 moves into slit or opening 110 and rests at or in the vicinity of throat 111, while upper portion 102 rides above the connecting location of thong 15 and V-shaped strap 9. Upper portion 102 and lower portion 104 are moved together until loop devices 112, 113 and 114 engage hook devices 115, 116 and 117. Thereafter, the free ends of shoelace 120 are tied together such as with a bow, or with some sort of a knot such as a square knot.

Figure 12:
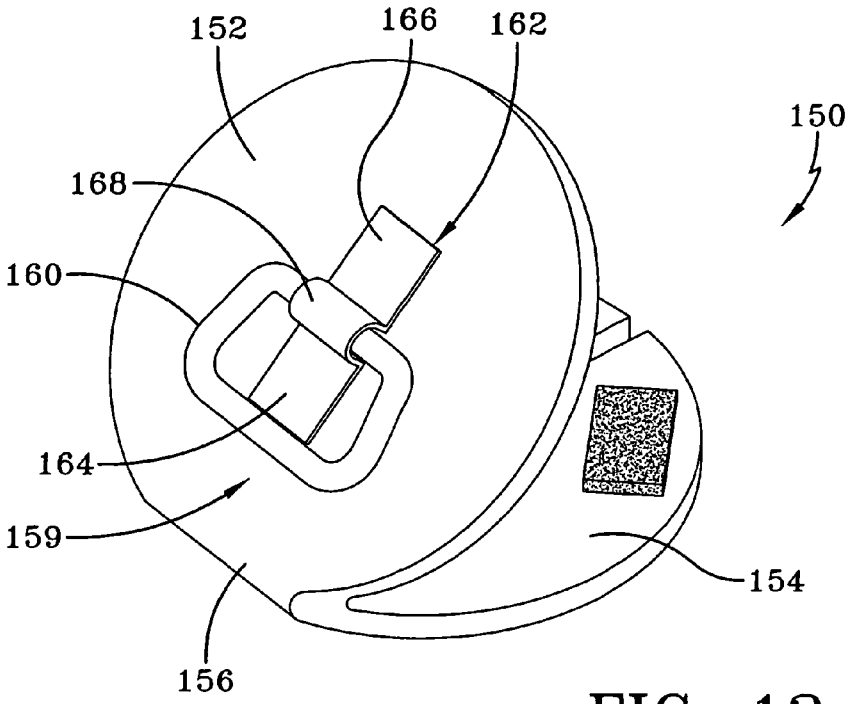
FIG. 12 is a perspective view of another variation of the first embodiment of the invention shown in FIGS. 6-10 and 11, in a closed condition.

It has been explained that a stabilizing device according to the invention can be used to carry various articles. An example is shown in FIG. 12 where a removable accessory or stabilizing device 150 is shown having an upper portion 152 and a lower portion 154, which are connected together at a folding portion or living hinge 156. A hooked loop device 159 is shown, but any other connecting structure could be used. On the exterior part of upper portion 152 is a connecting structure in the form of a closed loop 160 which is rotatably held in a cooperating connecting structure in the form of a loop holding device 162. Loop holding device 162 has portions 164 and 166 which lie flat against upper portion 152, and raised portion 168 in which loop 160 is rotatable. Stablizing device 150 operates in the manner of stabilizing device 50. Loop 160 can be used to hold a variety of things, such as key chains, a small carrying bag, a watch piece and the like.

Figure 13:
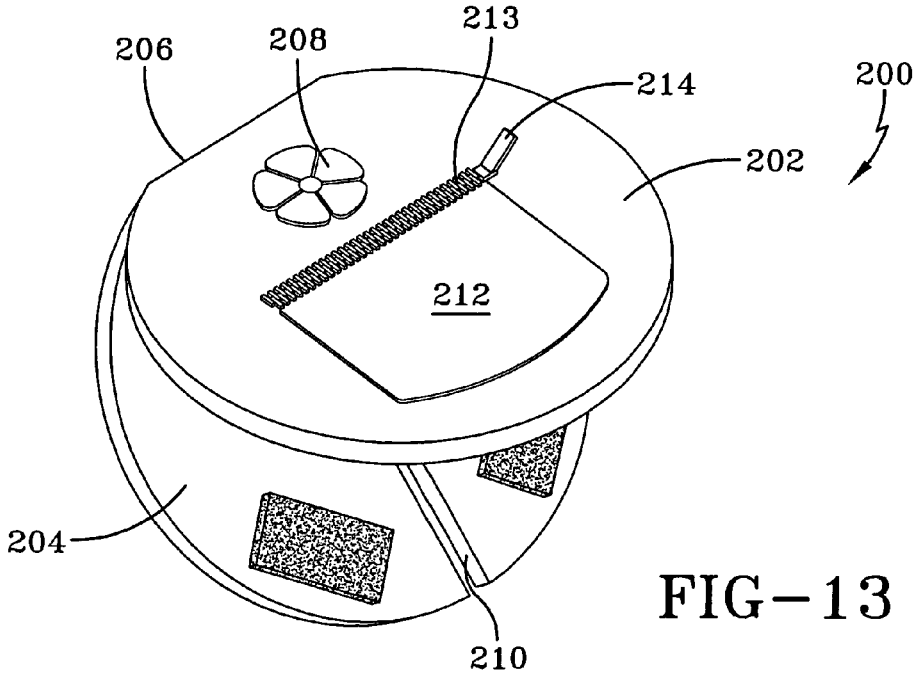
FIG. 13 is a perspective view of a further variation on the embodiment shown in FIGS. 6-10 and 11-12

Another removable accessory or stabilizing device 200 is shown in FIG. 13 having a pocket for carrying items. Stabilizing device 200 has an upper portion 202, a lower portion 204 which are connected at a folding portion or living hinge 206. Stabilizing device 200 has a decorative design 208 on the exterior of upper portion 202. A slit or opening 210 is located in lower portion 204, and the device operates in the same way as stabilizing device 50. Stabilizing device 200 has a pocket 212 in which many things can be held, such as coins, keys, pills, tablets, capsules, a timepiece and the like. Some releasable closing means such as a zipper 213 should be provided. Zipper 213 has a latch member 214 for opening and closing zipper 213.

Figure 14:
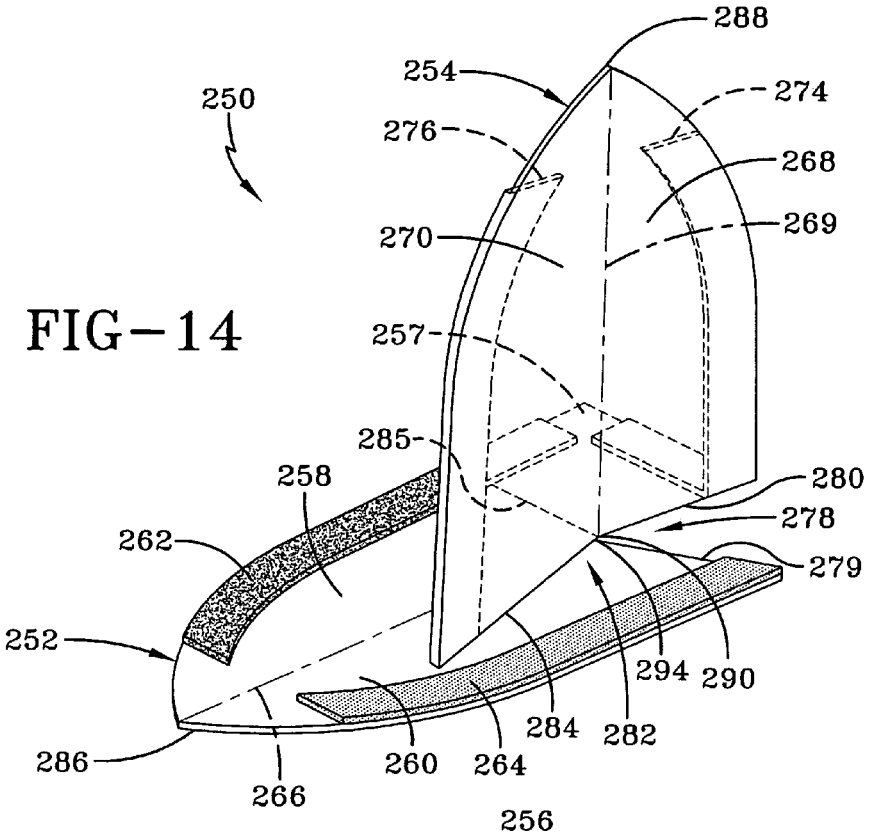
FIG. 14 is a perspective view of the interior of a second embodiment of the invention in an unfolded or open condition, with the arms of the stabilizing device being folded up.
Figure 15:
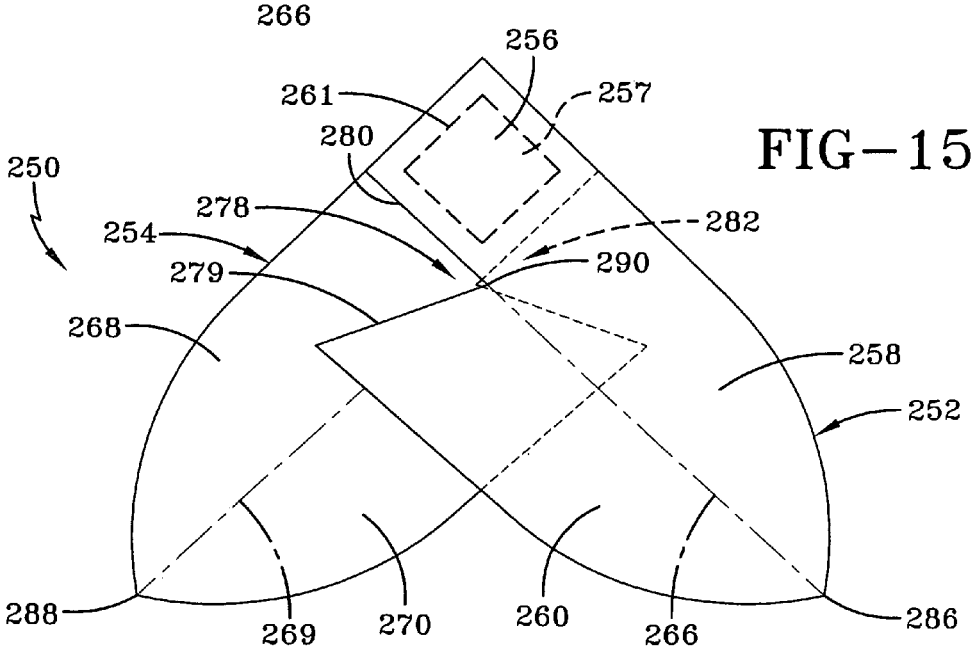
FIG. 15 is a top view of the exterior side of the embodiment shown in FIG. 14 in an unfolded condition.
Figure 16:
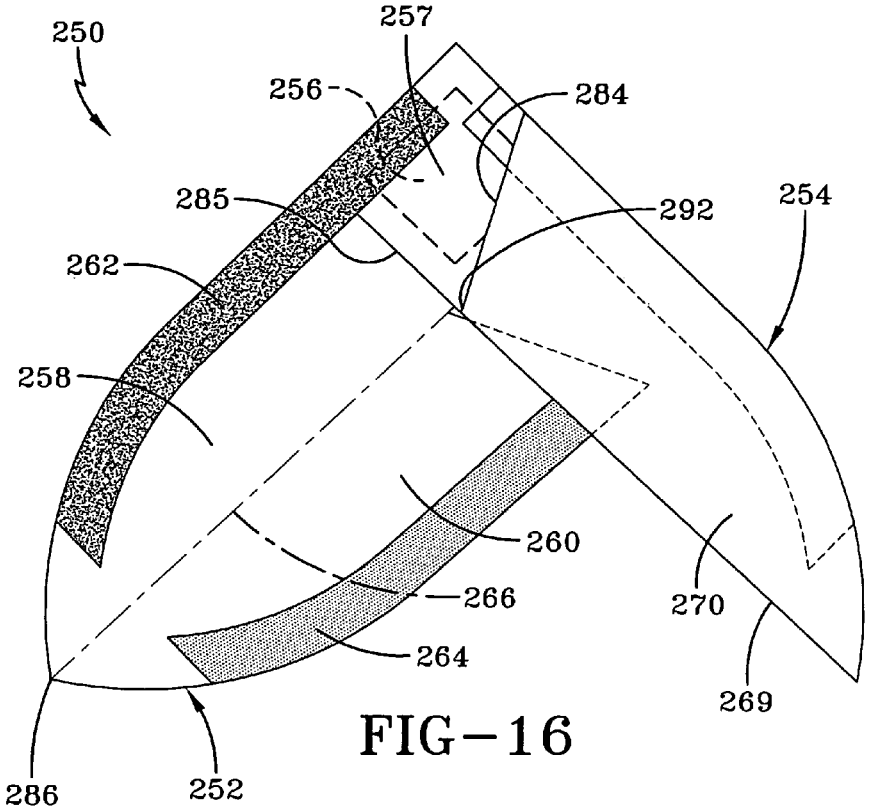
FIG. 16 is a top view of the interior side of the embodiment shown in FIG. 14 in an unfolded condition, with one of the arms in a folded condition.
Figure 17:
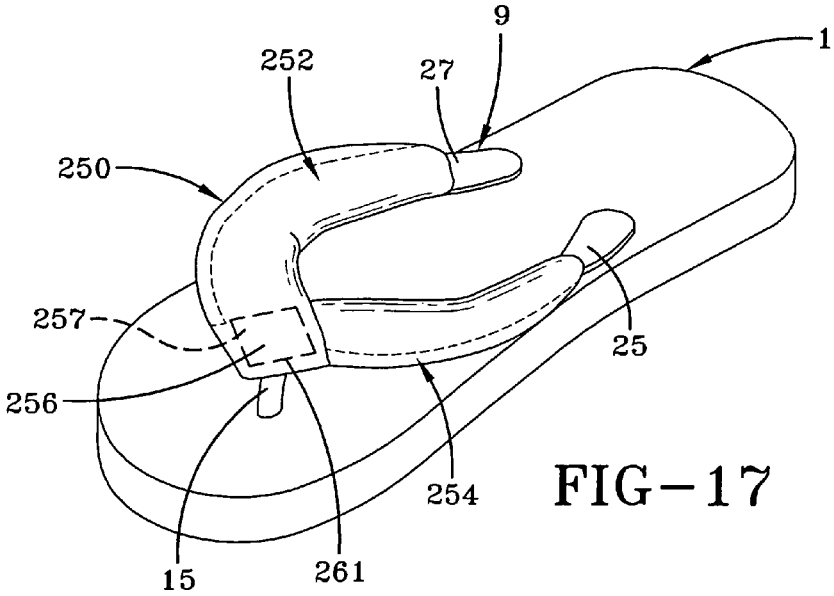
FIG. 17 is a perspective view of the embodiment of the invention shown in FIG. 14-16 installed on a V-strap sandal.

Another construction for a removable accessory or stabilizing device is shown in FIGS. 14-17. In this case, a stabilizing device 250 comprises a pair of arms 252 and 254. FIG. 14 shows stabilizing device 250 in a laid out position with the interior of arm 252 being visible, and arm 254 being folded up with its exterior portion being visible. FIG. 15 shows stabilizing device 250 being laid out with the exterior surface being visible, and FIG. 16 shows stabilizing device 250 being laid out with arm 254 being folded so that a hook portion 262 and a loop portion 264 of the connecting structure are engaged. FIG. 17 illustrates stabilizing device 250 installed on a V-strap sandal.

Arms 252 and 254 have overlapping end portions, and end portion 256 of arm 252 overlaps end portion 257 of arm 254 when device is installed as shown in FIG. 17. End portions 256 and 257 are stitched together at stitches 261. Arm 252 has an upper fold 258 and a lower fold 260. Connecting structure, which is shown for example as hook device 262, runs along an edge of upper fold 258 and loop device 264 runs along the edge of lower fold 260. A folding portion 266 runs generally along the center portion of arm 252, so that upper fold 258 and lower fold 260 can be folded over so that hook device 262 can engage and releasably lock loop portion 264 to hold arm 252 in a closed position. Likewise, arm 254 has an upper fold 268 and a lower fold 270, which are separated by a fold portion 269. A hook device 274 runs along the edge of upper fold 268, and a loop device 276 runs along the edge of lower fold 270 of arm 254.

Arm 252 has a V-shaped cut-out 278 bordered by edges 279 and 280. Likewise, arm 254 has a cut-out 282 defined by borders 284 and 285. Ann 252 has a free end 286 and arm 254 has a free end 288. Cut-outs 278 and 282 enable lower folds 260 and 270 of arms 252 and 254, respectively, to fold under the straps of a V-strap sandal without impairment of the other arm. Cut-out 278 has a corner 290 while arm 254 has a corner 294 at its cut-out 282. Fold portion 266 of arm 252 runs between free end 284 and corner 290, while fold portion 269 extends between free end 288 and corner 294 of arm 254.

The installation of stabilizing device 250 is described with respect to FIG. 17. The installation involves the manipulation of device 250. Arm 254 which underlies arm 252 as shown in FIG. 15 is initially wrapped around first strap portion 25 with upper fold 268 above and fold 270 below first strap portion 25, and then arm 252 is wrapped around second strap portion 27 with upper fold 258 and lower fold 260 below strap portion 27, assuming stabilizing device is being installed on V-strap sandal 1. The installation is very fast, and the resulting altered V-strap sandal need not look altered at all, but gives the appearance of a manufactured, unaltered sandal.

Stabilizing device 250 has a number of advantages. First, it extends over as much of the V-strap 9 as is desired, and this forces a larger portion of the foot of the wearer against sole 5 of sandal 1, increasing the stability of the wearer's foot in sandal 1. Furthermore, stabilizing device 250 can have a decorative surface which could cover up most or all of V-strap 9, which often is not particularly attractive to view. Stabilzing device 250 can have one or more pockets or carrying structure on one or both of arms 252 and 254, thus improving an added feature to stabilizing device 250.

Stabilizing device 250 has been described as incorporating two piece which are stitched together. However, it is also possible to make this as a unitary piece if desired, such as with an appropriate flexible plastic, leather or the like. Of course the hook portion and loop portion could have their positions reversed and/or changed, an could be entirely or partly replaced by other fastening structure or devices.

Figure 18:
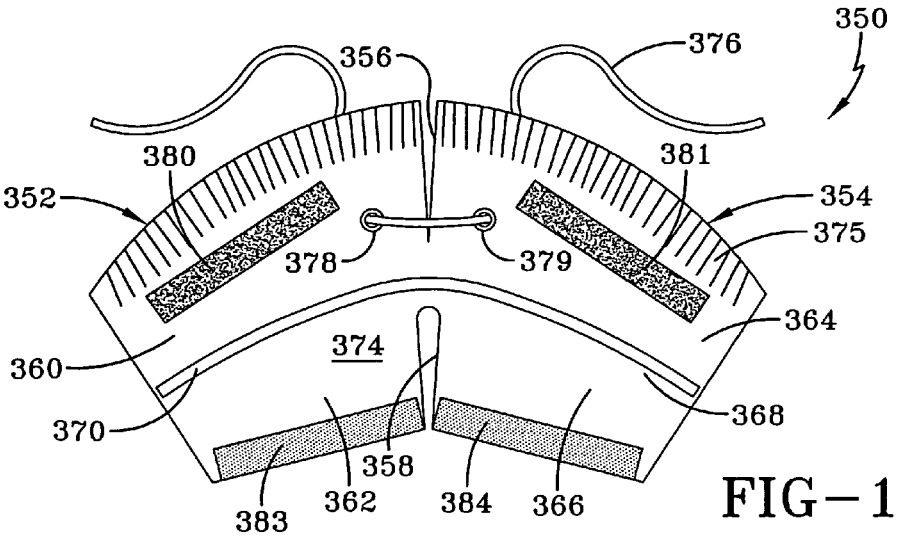
FIG. 18 is a top view of a third embodiment of the invention in an unfolded condition, showing the interior side of the embodiment.
Figure 19:
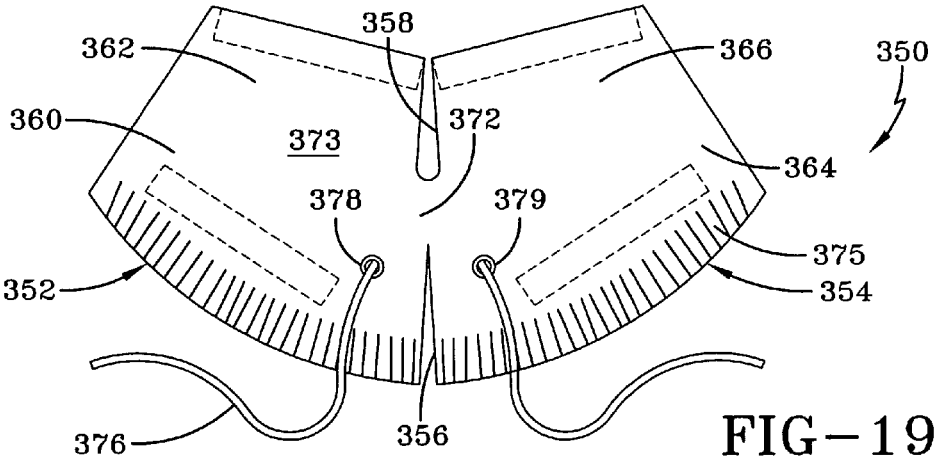
FIG. 19 is a top view of the exterior side of the embodiment shown in FIG. 18, in an unfolded condition.
Figure 20:
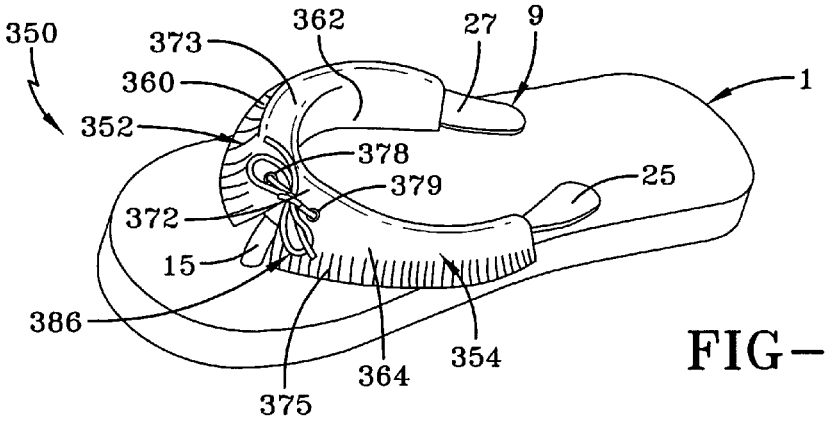
FIG. 20 shows the embodiment shone in FIG. 18-19 in perspective, installed on a V-strap sandal.

Another embodiment of the invention is shown in FIGS. 18-20. The latter figures show a removable accessory or stabilizing device 350 having a pair of arms 352 and 354 on opposite sides of a slit or other opening 356, and also on opposite sides of an opening 358 aligned with opening 356. Arm 352 has an upper portion or fold 360 and a lower portion or fold 362, and likewise arm 354 has an upper portion or fold 364 and a lower portion or fold 366. Stabilizing device 350 has a folding portion 368, and folding portion 368 can be a cord 370 attached thereto by adhesive, stitching or the like, to facilitate the folding process. Folding portion 368 has a forward portion 372 for engaging or being relatively close to throat 29 when stabilizing device 350 is manipulated and installed on V-strap sandal 1. Device 350 has an outer or exterior surface 373 shown in FIG. 18, and an inner or interior surface 374 shown in FIG. 18.

V-strap 9 can be decorated in innumerable ways. Upper portions 360 and 364 of respective arms 352 and 354 have fringes 375, and if stabilizing device 350 is made out of leather or a simulated leather, fringes 375 give device 350 a rustic or southwestern appearance. Pockets, item carrying loops and the like, can be incorporated on stabilizing device 350. A further decorating device, which is also utilitarian is a shoelace or leather thong 376 which through a pair of holes 378, 379 which can have a metal reinforcement. Shoelace 376 can be tied as explained below.

A pair of connecting structures shown as hook devices 380, 381 are attached to upper portions 360, 364 of respective arms 352, 354 by adhesives or the like, and a pair of aligned, cooperating connecting structures shown as loop devices 383, 384 are attached to respective lower portions 362, 366. When upper portions 360, 364 and lower portions 362, 366 are folded across folding portions 368, hook devices 380, 381 are initially in alignment with and then engage respective loop devices 383, 384 to releasably lock the respective hook and loop devices together.

In order to install stabilizing device 350 on a V-strap sandal such as sandal 1, one positions device 350 so that outer surface 373 is facing upwardly, and places device 350 on sandal 1, with the edges of arms 352, 354 bearing fringes 375 face forwardly in the general direction of thong 15. Stabilizing device 350 is then manipulated by bending it backwardly with cord 370 or folding portion 368, on opposite sides of openings 356, 358, becoming generally parallel with respective first and second strap portions 25, 27. Lower portions 362, 366 of arms 352, 345 are slid beneath respective first and second strap portions 25 and 27, and device 350 is moved forwardly until forward portion 372 of device 350 engages throat 29 of V-shaped strap 9. Respective upper portions 360, 364 are folded with lower portions 362 and 366 until respective pairs of hook and loop devices 380 and 383 and 381 and 384 engage to releasably lock stabilizing device 350 on V-strap sandal 1. Shoelace 376, which can optionally be looped around thong 15 to help secure stabilizing device 350 on sandal 1, is then tied into a bow 386, and device 350 is releasably secured on sandal 1. Sandal 1 now has the appearance of a finished, stylized footwear which can appear to be for more stylish and expensive than an actual flip-flop would be, while rendering the flip-flop or other V-strap sandal more comfortable and safer to wear.

Figure 21:
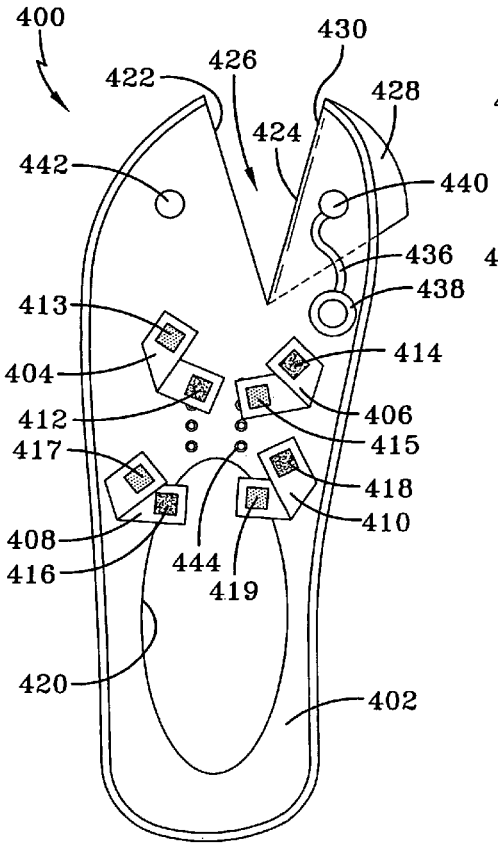
FIG. 21 is a top view of the interior of a fourth embodiment of the invention.
Figure 22:
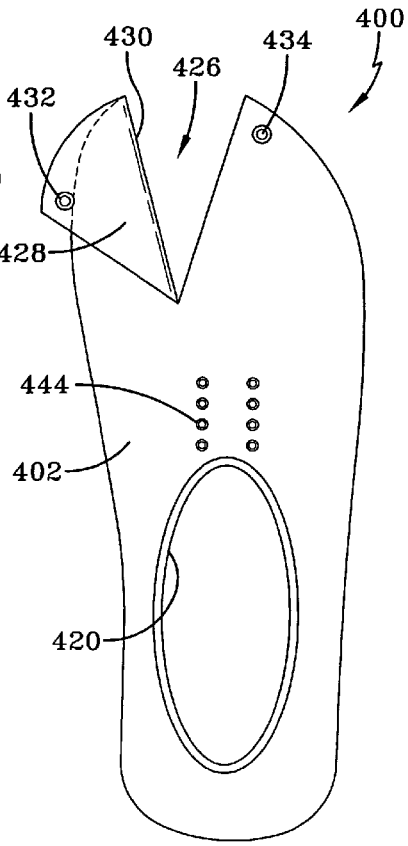
FIG. 22 is a top view of the exterior of the invention installed on a V-strap sandal.
Figure 23:
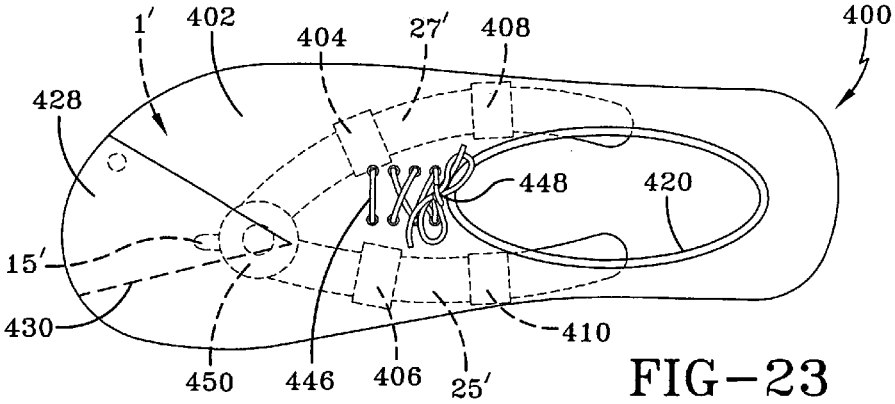
FIG. 23 is a top view of the invention.

Another embodiment of the invention is shown in FIGS. 21-23, where a removable accessory or stabilizing device 400 is depicted. Device 400 includes a shoe-like structure 402 for converting a V-strap sandal 1 shown in FIG. 23 into appearing to be a man's or woman's shoe. Shoe-like structure 402 includes a set of bands 404, 406, 408 and 410, each having a connecting structure in the form of hook portions 412, 414, 416 and 418, respectively, and cooperating connecting structure in the form of loop portions 413, 415, 417 and 419, respectively for being wrapped about portions of V-shaped strap 9 and being releasably locked together, to hold shoe-like structure 402 on sandal 1. Structure 402 has surfaces defining a foot-receiving aperture 420. The forward part of shoe-like structure 402 has a pair of surfaces 422, 424 defining a thong-receiving opening 426. A foldable flap 428 is foldable on a fold portion 430 to cover opening 426 and hide thong 15 when stabilizing device 400 is in use. Flap 428 is releasably held in the closed position by a two part snap 432, 434, snap part 432 not being visible from the outside when flap 428 is in the closed position. Another connection device for connecting shoe-like structure 402 is provided across opening 426, where an elastic band 436 having a loop 438 is attached to a button 440, loop 438 being releasably attachable to a second button 442 when structure 402 is to be releasably locked in place. In order to make shoe-like structure 402 look more like a dress shoe, a set of shoelace holes 444 are provided between foot-receiving aperture 420 and opening 426 for receiving a shoelace 446 which can be tied into a bow 448. Moreover, structure 402 can be solid in the area including shoelace holes 444 (i.e. there need not be an opening between the two rows of holes 446), and shoelace 446 could be permanently held in place.

V-strap sandal $\mathbf{1}^1$ is a modification of sandal 1. Thong $\mathbf{15}^1$ is connected to a ring 450, to which straps $\mathbf{25}^1$ and $\mathbf{27}^1$ are also connected. Thus, in this situation, thong $\mathbf{15}^1$ is not connected directly to V-shaped strap 9.

In order to install stabilizing device 400 on sandal 1 or any other V-strap sandal, one manipulates device 400. The user simply forms bands 404, 406, 408 and 410 into closed loops around strap portion 25 and 27, and puts loop 438 around button 442. Shoe-like structure is then slid forwardly to place thong 15 well inside opening 426. The user then puts a foot into foot-receiving aperture 420, and move the foot until thong $\mathbf{15}^1$ is in place between the first and second toes. V-strap sandal 1 is given the appearance of a dress shoe.

Figure 25:
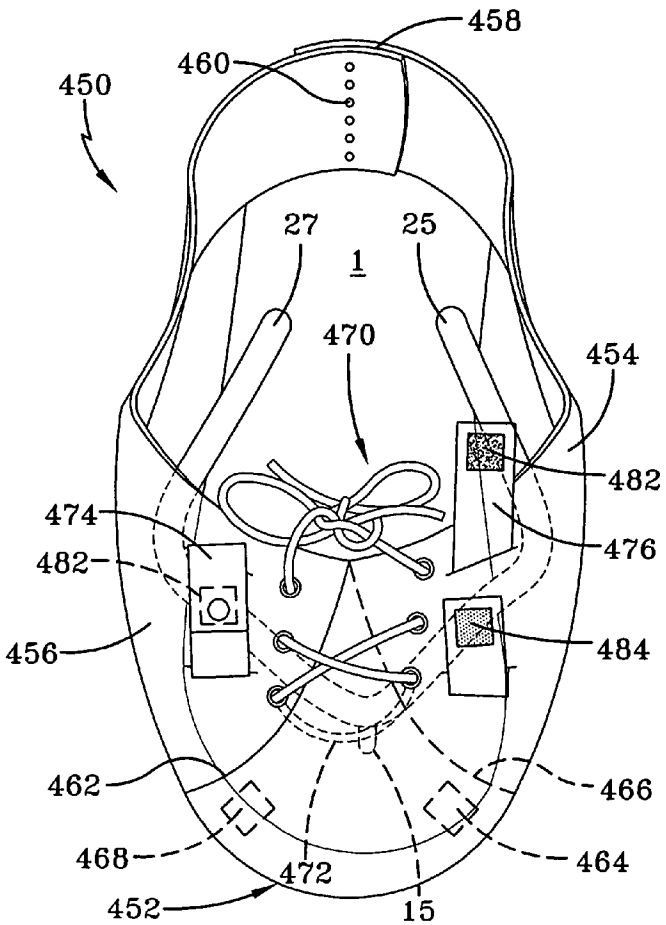
FIG. 25 is an outside view of the fifth embodiment of the invention installed on a V-strap sandal.
Figure 24:
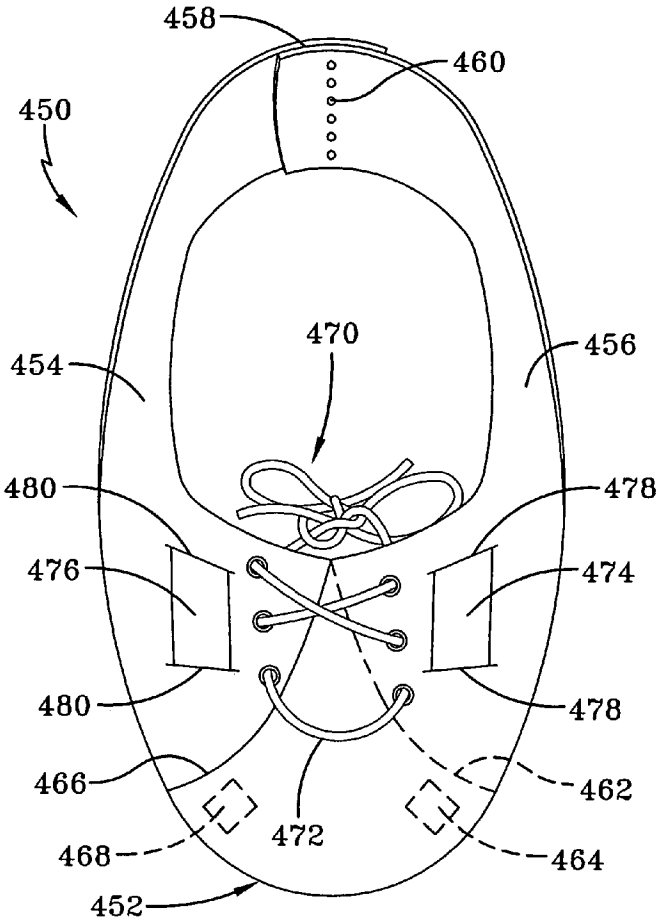
FIG. 24 is an inside view of a fifth embodiment of the invention.

An embodiment of the invention similar to that shown in FIG. 21-23 in that it has a shoe-like structure, is shown in FIGS. 24-25. FIG. 24 shows a removable accessory, stabilizing device or upper 450 having a shoe-like structure 452 for also converting a V-strap sandal 1 to footwear appearing to be a lace-up shoe. FIG. 24 shows device 450 in its inverted condition, looking at it from the inside. Upper 450 has a upper first flap 454 and an upper second flap 456. Upper first flap 454 and upper second flap 456 meet at a heel 458 where they are stitched together by means of stitches 460. The forward part of upper first flap 454 and upper second flap 456 cross over each other. Upper first flap 454 has a first end edge 462 which is releasably held to the forward end of upper second flap 456 by means of a pair of cooperating velcro hook and loop pads or connectors 464 which are connected to the respective upper first flap 454 and upper second flap 456. Likewise, upper second flap 456 has an end edge 466 which is attached to the forward part of upper first flap 454 by means of a pair of cooperating connecting structures or hook and loop connectors 468 which are connected to the respective flaps. A lace assembly 470 is provided both to give the upper 450 the appearance of a shoe and also to attach upper 450 to thong 15 of V-strap sandal 1. Lace assembly 470 has at its middle a closed portion 472 which wraps around the forward part of thong 15 to keep the forward portion of upper 450 in place on V-strap sandal 1. In order to attach upper 450 to straps 25 and 27, a pair of bands 474 and 476 extend through pairs of openings or slits 478 and 480. The inner portions of bands 474 and 476 are shown in FIG. 24 and the attaching ends of bands 474 and 476 are shown in FIG. 25. Bands 474 and 476 have cooperating connecting structures or hook and loop connectors 482 and 484, respectively, for wrapping around straps 25 and 27 to hold upper 450 to the respective straps.

FIG. 25 shows upper 450 attached to V-strap sandal 1. Midportion 472 of lace assembly 470 extends around the forward part of thong 15. Band 474 is shown wrapped around strap 27, whereas band 476 is shown in its open position. Upper 450 can be attached to thong 1 before a wearer's foot is inserted into V-strap sandal 1. Alternatively, the upper first flap 454 and upper second flap 456 can be separated at their forward ends by disconnecting hook and loop connectors 464 and 468, respectively.

It can be seen that even though upper 450 gives V-strap sandal 1 the appearance of a shoe, the V-strap sandal can easily be put on as would any other V-strap sandal. Bands 474 and 476 reduce the clearance between the upper part of a person's foot and straps 25 and 27 to stabilize sandal 1 on a wearer's foot. Furthermore, lace assembly 470 can be tightened to also reduce the play between upper 450 and V-strap sandal 1, and a wearer's foot, to further add to the stabilizing device on a wearer's foot. Upper 450 can be universally made to fit on almost any V-strap sandal, and variations would be simple to facilitate for unusual types of V-strap sandals.

Figure 27:
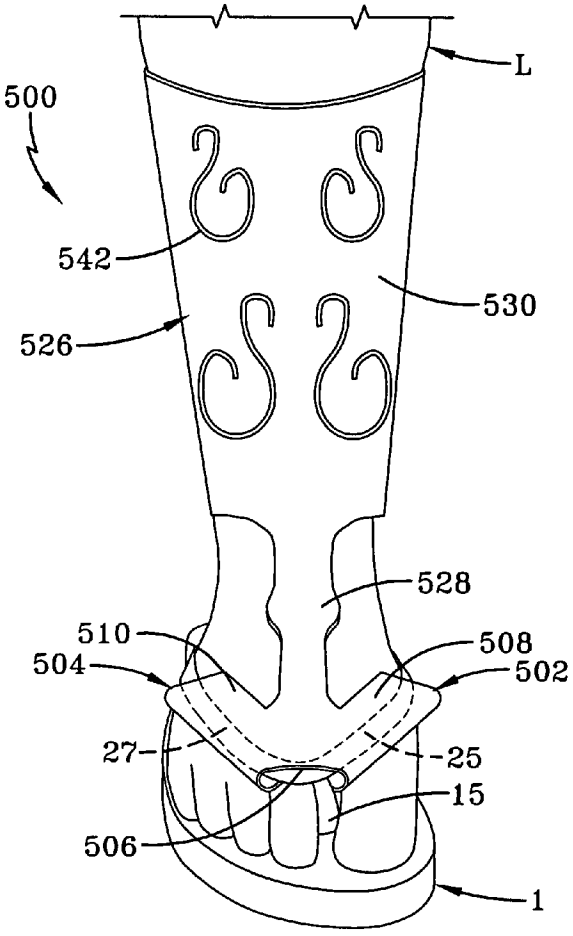
FIG. 27 is a view of the sixth embodiment as worn by a person.
Figure 26:
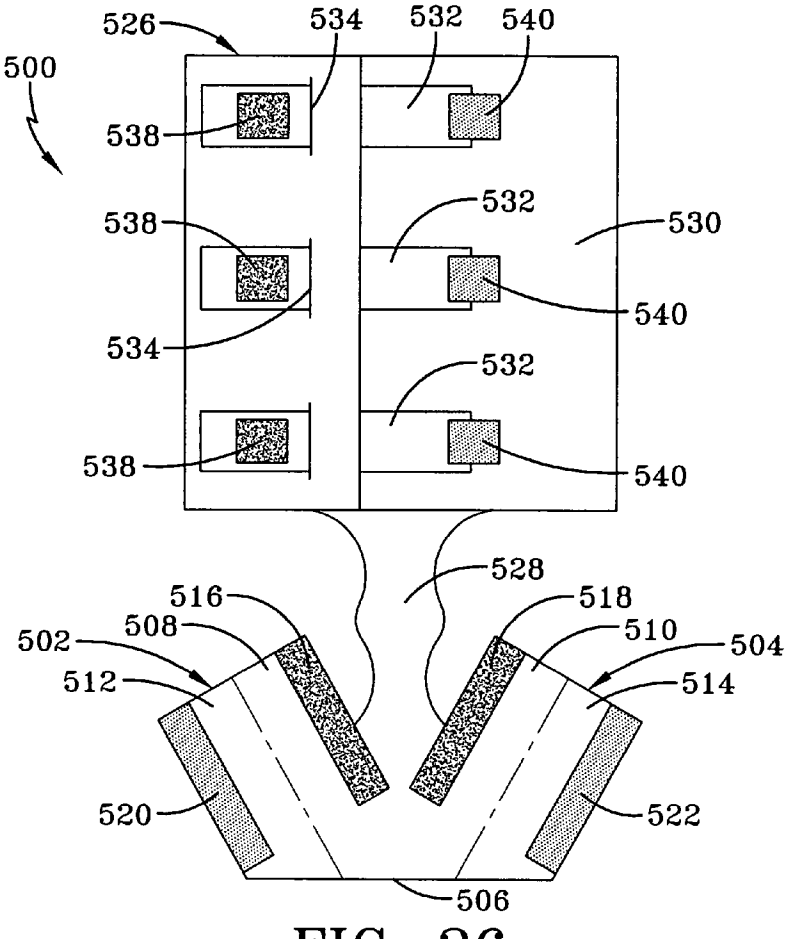
FIG. 26 is a view of a sixth embodiment of the invention.
Figure 28:
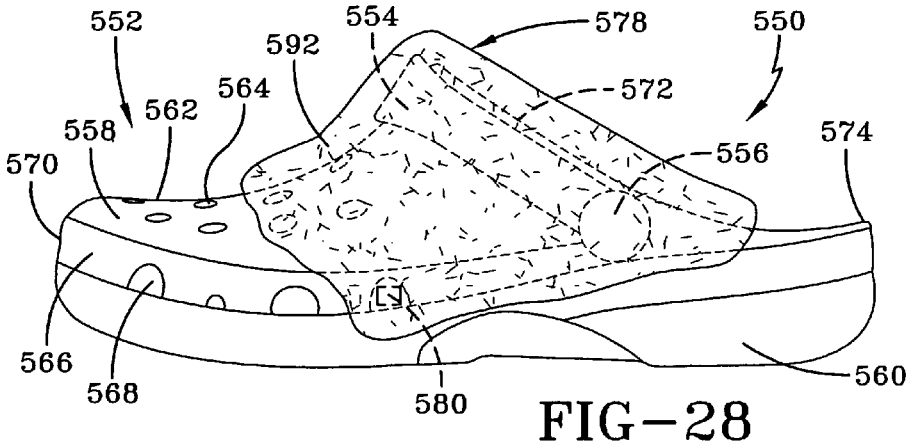
FIG. 28 is a side view of a seventh embodiment of the invention as applied to footwear.
Figure 29:
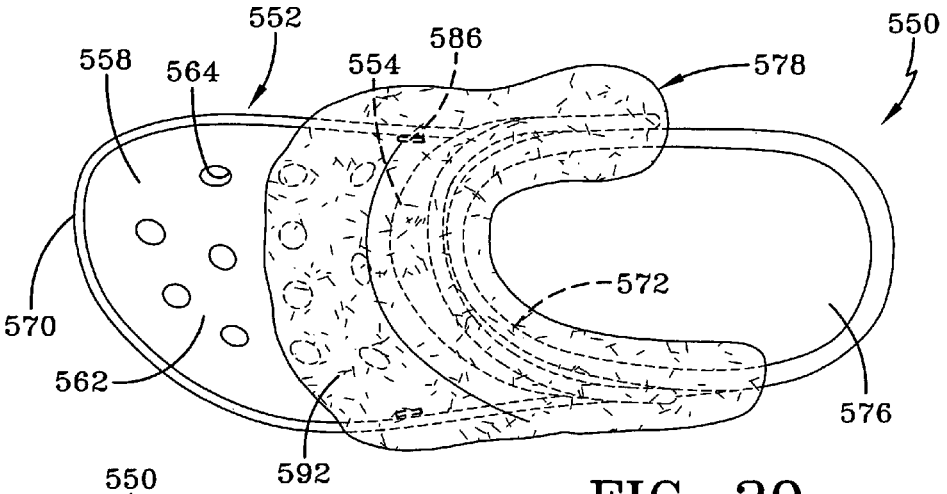
FIG. 29 is a top view of the seventh embodiment of the invention as applied to footwear.
Figure 30:
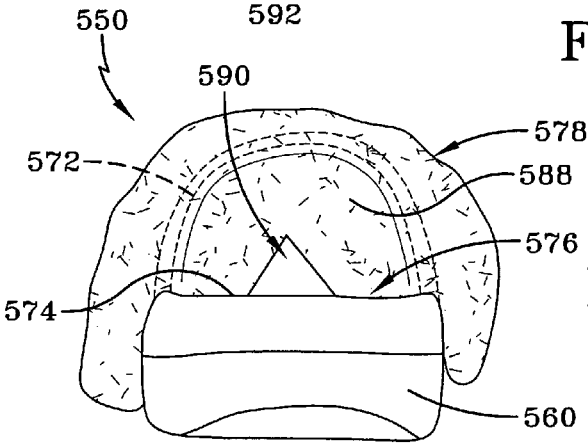
FIG. 30 is a rear view of the seventh embodiment of the invention as applied to footwear.
Figure 31:
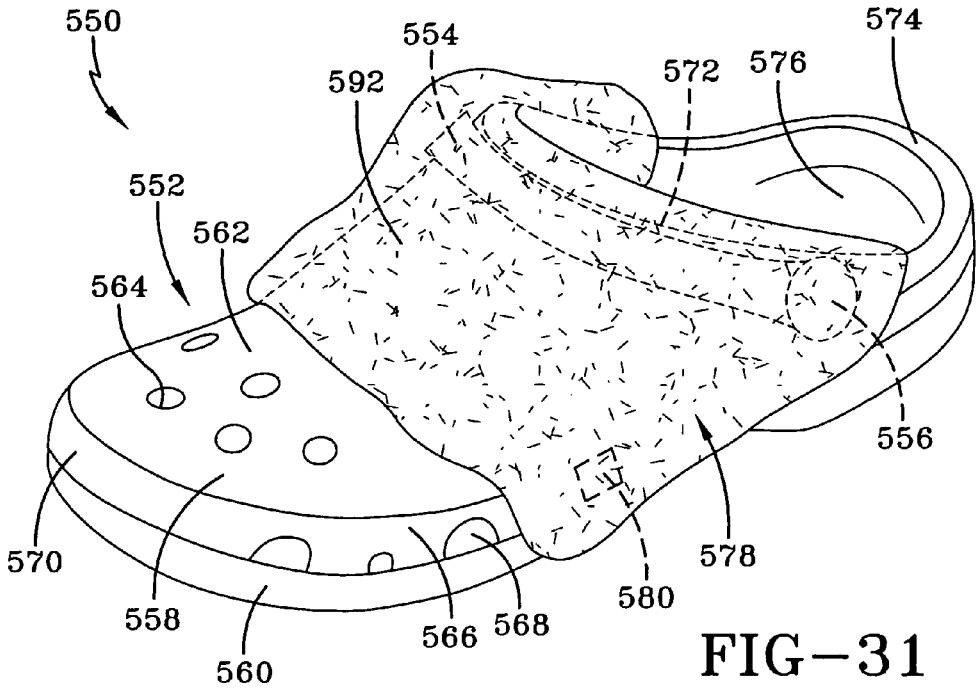
FIG. 31 is a perspective view of the seventh embodiment of the invention as applied to footwear.

Embodiments of the invention can add dramatic effects to the invention. FIG. 26 and 27 show an embodiment of the invention which can further be used to decorate the wearer's leg. The bottom portion of the invention is similar to that shown in FIG. 18-20. Upper 450 can be altered to serve other utilitarian purposes, such as the incorporation of pockets for various items.

Removable accessory or stabilizer device 500 is thus shown in FIGS. 26 and 27. Referring first to FIG. 26, which shows stabilizing device 500 before it is assembled on a V-strap sandal, device 500 has a pair of arms 502 and 504. Arms 502 and 504 share a straightforward edge 506. Arms 502 and 504 have an upper portion 508 and 510, respectively and a lower portion 512 and 514, respectively. A pair of hook devices 516 and 518, cooperate with loop devices 520 and 522 on arms 502 and 504, respectively, to releasably lock upper portions 508 and 510 to lower portions 512 and 514 on the respective straps 25 and 27, devices 516, 518, 520 and 522 being connecting structures. A leg wrap-around 526 is connected to arms 502 and 504 by means of a connecting piece 528. Leg wrap-around 526 includes a strap 530 having a transverse width sufficient to wrap around a variety of sizes of people's legs. A set of bands 532, which can be made of the same material as leg wrap-around 526, extends respectively through openings or slits 534, and respectively through slits 536 which are respectively parallel to slits 536. The right end of the respective bands 532, as viewed in FIG. 26 is shown as being attached to leg wrap-around 526 by such means of an appropriate attaching device like an adhesive, to which a hook device 538 is also attached. When leg wrap-around 526 is to be attached to a wearer's leg, one simply pulls the respective bands 532 until leg wrap-around 530 is comfortably secured to the leg, and hook devices 538 with bands 532 are pulled through slits 534 and attached to the respective loop devices 540. There are of course many other ways of attaching leg wrap-around 526 to a person's leg.

FIG. 27 shows stabilizing device 500 attached to a V-strap sandal 1 worn on a foot and leg L. Arms 502 and 504 are wrapped around the respective straps 25 and 27, connecting piece 528 lies across the upper portion of the wearer's foot and is connected to leg-around 526 which is attached to the lower portion of leg L of the wearer. Device 500 can be made attractive with an appropriate design as shown at 542. Arms 502 and 504 adds stability to stabilizing device 500 since they help press the wearer's foot against the sole of V-strap sandal 1, while further connecting stabilizing device 500 to sandal 1. The leg wrap-around 526 can also help to keep stabilizing device 500 secure on V-strap sandal 1. Stabilizing device 500 can be made of any flexible material, leather being an appropriate product with which to make stabilizing device 500.

The invention is not limited to V-strap sandals. A currently popular type of footwear of the type disclosed in U.S. Pat. No. 6,993,858 entitled "Breathable Footwear Pieces" which is sold by Crocs, Inc. of Niwot, Colo. Referring to FIGS. 28-31, a breathable footwear 550 is shown in a side view, a top view, a rear view and in perspective. Footwear 550 has a base section 552, a strap section 554 held in place by buttons 556, and upper 558 and a sole 560. Upper 558 has a generally horizontal portion 562 that has apertures or ventilators 564. There is also a vertical region 566 having apertures or ventilators 568. Upper 558 has a toe region 570 which tapers to generally follow the contour of a foot. There is space between the top of the foot of a person wearing breathable footwear 550 and the inside of upper 558. Upper 558 further has an upper opening perimeter 572. Sole 560 has a rear sole perimeter 574, and a person's heel rests on support base 576.

Figure 32:
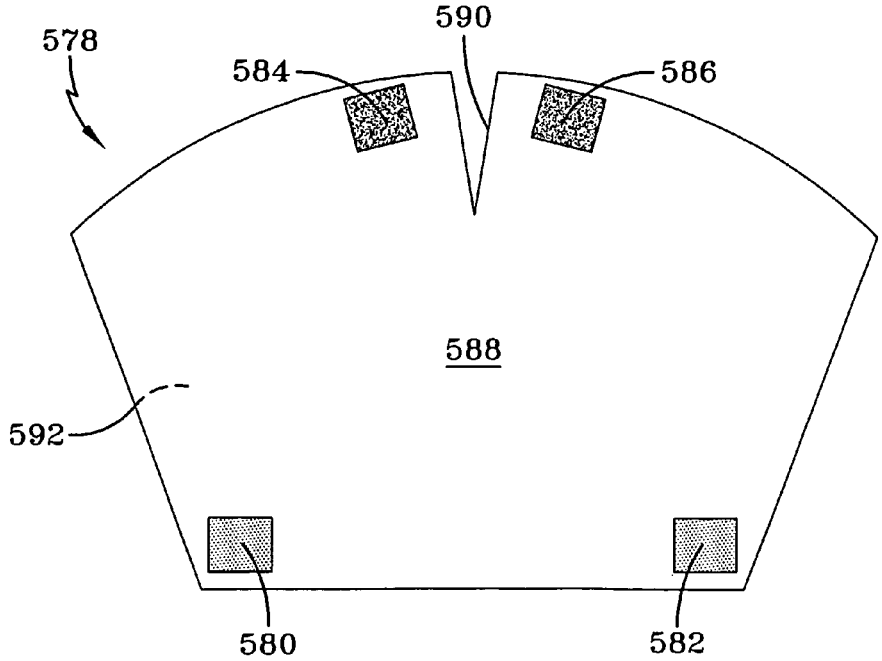
FIG. 32 is a plan inside view of the seventh embodiment of the invention in an open condition.

An inside view of a removable accessory or stabilizer 578 is shown in FIG. 32. Stabilizer 578 is made of a pliant or flexible material. Stabilizer 578 is made to extend inside of breathable footwear 550 as explained below, and includes a connecting device or connecting structure, such as hook devices 584, 586 and cooperating loop devices 580, 582. The connecting structure in this and other embodiments could also be adhesives, adhesive tape, mechanical snaps, magnets, buttons and button holes, zippers, laces and stitching. Stabilizer 578 has an interior portion 588 for slipping inside footwear 550, and includes a slit 590 to enable stabilizer 578 to lie flat against the interior surfaces of footwear 550. An exterior portion 592 is provided for lying on the outside of footwear 550 as explained below.

Stabilizer 578 can easily be attached to, and removed from, footwear 550. In order to assemble stabilizer 578 in footwear 550, interior portion 588 as shown in FIG. 32 is inserted into footwear 550 with the inside portion, as shown in FIG. 32, facing the interior surfaces of upper 552. Hook devices 584 and 586 are held against two of ventilators 568 on opposite sides of footwear 550, hook devices 584 and 586 having been attached to stabilizer 578 to line up with a pair of ventilators when stabilizer 578 is slid into footwear 550. The exterior portion 592 of stabilizer 578 is then folded over upper opening perimeter 572 and hook devices 584 and 586 are connected to loop devices 580 and 582 respectively. Stabilizer 578 is shown in its installed position in each of FIGS. 28-31. Stabilizer 578 can be very attractive in appearance, and decreases the distance between the upper portion of a wearer's foot that has been inserted into footwear 550, and upper 552, to render footwear 550 more stable on the wearer's foot.

Many different types of material can be used for stabilizer 578. If the wearer does not intend to put footwear 550 in water, many different fabrics, shearling or artificial shearling can be used with the furry part facing the wearer's foot on the inside of footwear 550 and exterior portion 592 being visible on the exterior side of upper 558. If the wearer is going to use footwear 550 in water, there are many types of rubber, artificial rubber and other plastic materials that shed water which could be used, and which preferably would have some thickness, preferably of about ⅜ of an inch of compressible material. This would allow the wearer to easily insert of foot into footwear 550, enable comfortable walking by the wearer with footwear 550 and stabilize the wearer's foot in footwear 550.

Stabilizer 578, like the other embodiments of the invention, can be very decorative. Stabilizer 578 can be modified to serve other purposes as well, some of which have been discussed previously with respect to the other embodiments of the invention. For example, one of more pockets could be incorporated in stabilizer 578 to enable the wearer to carry many types of items, and if stabilizer 578 is large enough, pockets for carrying cell phones can be used.

Each of the embodiments described above are made of flat, sheet-like components which are foldable against each other and are foldable on the parts of the footwear to which they are to be attached to improve the fit and appearance of the footwear, and to stabilize the forward part of a wearer's foot to impede movement of the V-strap sandal or other footwear with respect to the wearer's foot. As shown in the drawings, each of the devices is flat when installed on the various types of footwear so as to remain compact on that footwear.

The invention has been described in detail with particular reference to its preferred embodiments, and variations and modifications within the spirit and scope of the invention may occur to those skilled in the art from the foregoing description and from the appended claims.

The invention claimed is:

1. A stabilizing device for a V-strap sandal configured with a sole and a U-shaped strap extending over the forward part of the sole, the V-strap sandal is configured to decrease the gap between the U-shaped strap and the sole, the U-shaped strap having opposite side portions extending along opposite sides of the sandal for passing over the top or around the sides of a wearer's foot, and a thong for fitting between the first and second toes of a wearer's foot, the thong being attached at one end to the sole and at the other end to the strap, said stabilizing device having a forward portion for facing the forward part of the V-strap sandal and a rearward portion for facing the rearward part of the V-strap sandal, said stabilizing device comprising:

a visible structure for extending over at least a part of the opposite side portions of the U-shaped strap, said visible structure having a forward position and a rearward position, and being visible when installed on a V-strap sandal, said visible structure being flat and having a visible exterior surface and non-visible interior surface when said stabilizing device is installed on a V-strap sandal;

a flexible lower portion for being located in the gap when said stabilizing device is on a V-strap sandal, said lower portion being configured to receive a wearer's foot beneath said lower portion and having a flexible peripheral edge, said flexible lower portion being flat and having an interior surface for engaging the substantial entire non-visible interior surface of said visible structure when said stabilizing device is installed on the V-strap sandal; said lower portion having a connected part connecting said flexible lower portion and said visible structure, and a non-connected part having a peripheral edge and an inner part;

a single linear folding portion integral with said visible structure and said flexible lower portion for combining said visible structure and said lower portion as an integral unit, said single linear folding portion lying along a straight line;

a straight slit extending through and between said flexible peripheral edge in said forward portion of said stabilizing device and the inner part of said lower portion of said stabilizing device for receiving a thong of the V-strap sandal, said straight slit being transverse to said single linear folding portion and having a longitudinal axis, said longitudinal axis extending through the middle of said single linear folding portion, said slit receiving the thong of the V-strap sandal when said forward portion of said stabilizing device is positioned to face the forward part of the V-strap sandal and said straight slit is positioned to face the thong, said straight slit receiving the thong as said stabilizing device is moved forwardly towards the thong and the forward part of the V-strap sandal, said straight slit further dividing said lower portion into a pair of lower flexible portions; and connecting structure for releasably connecting the visible structure to the U-shaped strap, said connecting structure being disposed forwardly of the thong upon installation of said stabilizing device on a V-strap sandal;

said lower portion being configured to decrease the gap between the U-shaped strap and the sole for decreasing the play between the wearer's foot and the sole to stabilize the V-strap sandal on the wearer's foot.

2. A stabilizing device for V-strap sandals, the V-strap sandals being configured to include a U-shape strap having a sole facing portion and an opposite non-sole facing portion, with a gap existing between the sole facing portion of the U-shaped strap and the sole and a thong for fitting between the first and second toes of a wearer's foot, the thong being attached at one end to the sole and at the other end to the strap, said stabilizing device comprising the following:

an upper portion having a shape of a segment of a circle with an upper portion periphery, said segment of said upper portion having a linear chord defining an upper portion linear chord edge, said upper portion having a front portion, and an upper left part and an upper right part, and a predetermined size and shape;

a lower portion having a shape of a segment of a circle with a lower portion periphery, with the exception of a radial linear slit extending through said lower portion periphery, for receiving the thong of a V-strap sandal, said segment of said lower portion having a linear chord defining a lower portion linear chord edge, said lower portion having a front portion, a predetermined size and shape identical to the predetermined size and shape of said upper portion with the exception of said linear slit and said slit opening;

a single linear folding portion at said rear portions of said upper portion and said lower portion at said upper portion chord edge and said lower portion chord edge for providing a single linear fold of said upper portion and said lower portion for rendering at least a part of said upper portion to be in contact with the non-sole facing portion of the U-shaped strap and for rendering at least a part of said lower portion to be in contact with the sole facing portion of the U-shaped strap, said single linear folding portion having opposite ends and said single linear folding portion further causing said upper portion and said lower portion to face each other, said upper portion being foldable at said single linear folding portion and said upper portion and said lower portion being in engagement with each other to form overlapped, aligned, mutually-engaging upper and lower portions having a common periphery with the exception that the upper portion periphery overlaps said linear slit, said linear slit having a longitudinal axis that is transverse to said single linear folding portion, said lower portion lessening the gap between the sole facing portion of the U-shaped strap and the sole to stabilize the V-strap sandal when installed on the V-strap sandal as compared to the stability of the V-strap sandal and the wearer's foot having a wider gap between the sole facing portion of the V-shaped strap and the sole without said stabilizing device;

said linear slit forming left and right flexible segmented semi-circular lower left and right fitting portions, said lower left and right fitting portions being configured to receive the thong of a V-strap sandal when said upper and lower portions are moved forwardly towards the thong with said linear slit in alignment with the thong of the sandal beneath the U-shaped strap on opposite sides of the thong; and connecting structure for connecting the front portions of said upper and lower portions on opposite sides and forwardly of the thong when said connecting structure is located forwardly of the thong and said linear folding portion is located rearwardly of the thong, for preventing the sliding of said stabilizing device from the V-strap sandal, said connecting structure comprising upper left connecting structure and upper right connecting structure on the upper left and upper right parts of said upper portion, and lower left connecting structure and lower right connecting structure on the respective lower left and lower right fitting portions of said lower portion, said upper left connecting structure and said upper right connecting structure being in the path of and cooperating with the respective lower left connecting structure and lower right connecting structure to selectively connect or disconnect said stabilizing device from a V-strap sandal;

said upper left connecting structure, said upper right connecting structure, said lower left connecting structure and said lower right connecting structure being located forwardly of the thong of a V-strap sandal when said stabilizing device is on the V-strap sandal, wherein one of the upper left connecting structure and the lower left connecting structure is a loop device and the other of the upper left connecting structure and the lower left connecting structure is a cooperating hook device, and wherein one of the upper right connecting structure and the lower right connecting structure is a loop device and the other of the upper right connecting structure and the lower right connecting structure is a cooperating hook device.

3. A stabilizing device according to claim 2 wherein said upper portion, said lower portion and said single folding device are made from a material selected from the group consisting of a wool product, an artificial wool product, a flexible plastic, leather and simulated leather.

* * * * *